United States Patent [19]

Katayama et al.

[11] 4,198,229

[45] Apr. 15, 1980

[54] METHOD OF DEPHOSPHORIZATION OF METAL OR ALLOY

[75] Inventors: Hiroyuki Katayama, Munakata; Makoto Inatomi; Hiroyuki Kajioka, both of Kitakyushu; Yasushi Nakamura; Michihisa Ito, both of Tokyo; Kazuumi Harashima, Kawasaki; Takamasa Ohno, Hikari, all of Japan

[73] Assignee: Nippon Steel Corporation, Tokyo, Japan

[21] Appl. No.: 855,265

[22] Filed: Nov. 28, 1977

Related U.S. Application Data

[63] Continuation of Ser. No. 700,193, Jun. 28, 1976, abandoned.

[51] Int. Cl.[2] ..... C21C 7/02

[52] U.S. Cl. ..... 75/53; 75/58

[58] Field of Search ..... 75/53–58

[56] References Cited

U.S. PATENT DOCUMENTS

| | | | |
|---|---|---|---|
| 3,124,450 | 3/1964 | Matuschkovitz | 75/57 |
| 3,622,302 | 11/1971 | Hayashi | 75/58 |
| 3,876,421 | 4/1975 | Takemura | 75/58 |
| 3,929,464 | 12/1975 | Todd | 75/58 |
| 4,054,445 | 10/1977 | Ramacciotti | 75/58 |

*Primary Examiner*—P. D. Rosenberg

*Attorney, Agent, or Firm*—Toren, McGeady and Stanger

[57] ABSTRACT

A carbon-unsaturated molten metal or molten alloy containing elements more oxidizable than iron such as chromium and silicon is dephosphorized by addition of a flux composition comprising calcium carbide and a halide of alkali earth metal such as calcium fluoride in a non-oxidizing atmosphere, and thereafter the slag as a by-product is stabilized against formation of undesirable gases. This method when employed in refining ferrochromium or crude stainless steel makes feasible dephosphorization, and it is particularly suited for economical production of low phosphorus stainless steel.

16 Claims, 30 Drawing Figures

PERCENTAGE OF NITROGEN, PHOSPHORUS, SULFUR AND OXYGEN AS IMPURITIES IN A STEEL WITH RESPECT TO THE LONGITUDINAL INGOT LENGTH

ELECTROSLAG REMELTING APPARATUS

PERCENTAGE OF PHOSPHORUS AND SULFUR IN A MOLTEN HIGH CARBON FERROCHROMIUM WITH 7.5 % C AND 64.1 % Cr AS FUNCTION OF TREATMENT TIME

DEPHOSPHORIZING APPARATUS

PARTITION COEFFICIENT Lp OF PHOSPHORUS IN SLAG PHASE AS FUNCTION OF Ca CONCENTRATION THEREIN

CaC2/Ca RATIO IN SLAG AS FUNCTION OF EFFECTIVE CARBON CONCENTRATION

FIG.7

EFFICIENCY $\eta/\eta_0$ OF DEPHOSPHORIZATION AS FUNCTION OF OXYGEN CONCENTRATION IN Ar ATMOSPHERE

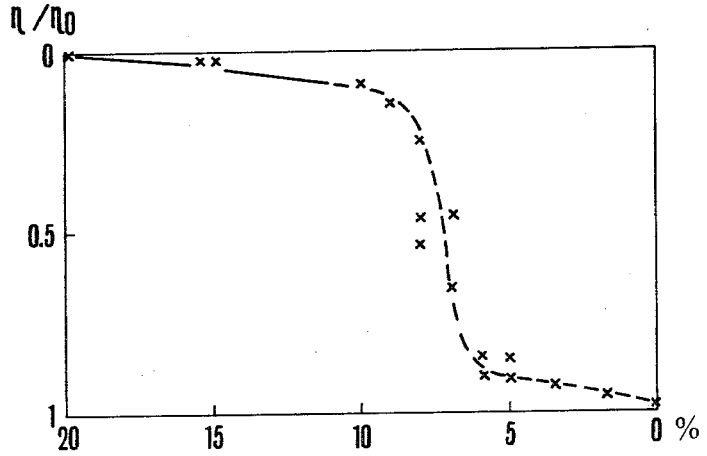

FIG.8

EFFICIENCY $\eta/\eta_0$ OF DEPHOSPHORIZATION AS FUNCTION OF $CO_2$ GAS OR $H_2O$ GAS CONCENTRATION IN Ar ATMOSPHERE

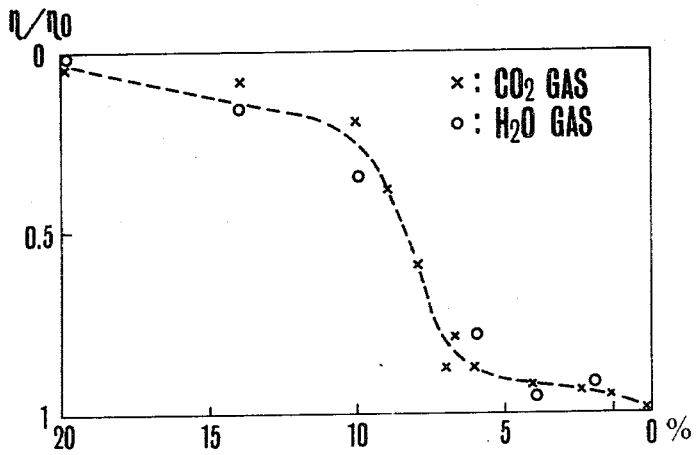

$\eta_0$ MEANS DEPHOSPHORIZATION RATE UNDER Ar ATMOSPHERE $\eta$ MEANS DEPHOSPHORIZATION RATE UNDER Ar ATMOSPHERE CONTAINING OXIDIZING GAS EFFICIENCY (%) OF DEPHOSPHORIZATION IN MOLTEN METAL AS FUNCTION OF $N_2$ PARTIAL PRESSURE IN AR ATMOSPHERE WITH A PARAMETER BEING THE PERCENTAGE OF A FLUX OF $CaC_2$ AND $CaF_2$ USED EFFICIENCY (%) OF DEPHOSPHORIZATION IN MOLTEN METAL AS FUNCTION OF $N_2$ PARTIAL PRESSURE IN AIR ATMOSPHRE WITH A PARAMETER BEING THE PERCENTAGE OF A FLUX USED EFFICIENCY (%) OF DEPHOSPHORIZATION IN A MOLTEN 18%Cr-8%Ni-0.7%C CRUDE STAINLESS STEEL AS FUNCTION OF $O_2$ CONTENT IN THE STEEL BEFORE ADDITION OF A FLUX OF 70% $CaC_2$ AND 30% PURIFIED FLUORITE THE AMOUNT OF A FLUX OF 50% $CaC_2$, 15% CaO AND 30% $CaF_2$ REQUIRED TO EFFECT DEPHOSPHORIZATION AT AN EFFICIENCY AS FUNCTION OF C IN A MOLTEN 16-20% Cr FERROALLOY WITH A PARAMETER BEING THE EFFICIENCY OF DEPHOSPHORIZATION

DEPHOSPHORIZING APPARATUS COMBINED WITH A CONTINUOUS CASTING MACHINE

A METHOD OF ESTABLISHING A DEPHOSPHORIZING APPARATUS WHILE REMOVING THE INITIALLY PRESENT SLAG

APPARATUS FOR OXIDIZING $Ca_3P_2$ IN SLAG

PRODUCTION OF $PH_3$ IN AIR FROM SLAG CONTAINING $Ca_3P_2$

VARIATION WITH TIME OF THE PERCENTAGE OF P CHANGED FROM $Ca_3P_2$ TO STABILIZED NONTOXIC FORM IN SLAG

CONCENTRATION OF $PH_3$ PRODUCED FROM SLAG WHEN OXIDIZED IN AIR AS FUNCTION OF TREATMENT TEMPERATURE

FORMATION OF STABILIZED PHASE AT THE SURFACE OF A SLAG BLOCK OCCURRING IN AN INTERMEDIATE STEP OF OXIDATION PROCESS

VARIATION WITH TREATMENT TIME OF THE THICKNESS OF A STABILIZED SURFACE LAYER OF A SLAG BLOCK DURING OXIDATION TREATMENT WITH A PARAMETER BEING THE TREATMENT TEMPERATURE

DISTRIBUTION OF PHOSPHORUS BETWEEN $Ca_3P_2$ AND THE OTHER FORMS IN SLAG SURFACE LAYER BEFORE AND AFTER OXIDATION TREATMENT

DEPHOSPHORIZING APPARATUS ADAPTED TO SERVE AS A REACTOR FOR BURNING THE USED FLUX

VARIATION WITH BURNING TIME OF THE PERCENTAGE OF $Ca_3P_2$ REMAINING UNCHANGED IN THE FLUX AFTER THE BURNING AS FUNCTION OF RATED AMOUNT OF $O_2$ SUPPLIED TO THE BURNER AT AN AVERAGE REACTION TEMPERATURE OF 1200°C AS MEASURED AT THE REFRACTORY WALL SURFACE

DEPENDENCE OF THE STABILIZED LAYER FORMING SPEED ON THE SUSTAINED TEMPERATURE WHEN THE FLUX IS OXIDIZED

DEPENDENCE OF $CaCO_3$ COATING LAYER FORMING SPEED ON TEMPERATURE AND $CO_2$ CONCENTRATION WHEN THE OXIDIZED $CaC_2$–$CaF_2$ SLAG IS SUBJECTED TO CARBONATIZATION IN A $CO_2$ ATMOSPHERE

METHOD OF DEPHOSPHORIZATION OF METAL OR ALLOY

This is a continuation of application Ser. No. 700,193, filed on June 28, 1976 now abandoned.

BACKGROUND OF THE INVENTION

1. Field of the Invention

This invention relates to the refining of metal and alloy, and more particularly to a method of dephosphorizing a metal, or an alloy containing more oxidizable elements than iron such as Cr, Mn, Si, Al, Mo, Zr, Nb, V and/or W, for example, ferroalloys and alloy steels.

2. Description of Prior Art

Conventionally the oxidizing refining has been employed to achieve dephosphorization of a molten metal or alloy. This is performed by oxidizing the molten metal under a basic slag to convert phosphorus to $P_2O_5$ which is then converted to $Ca_3(PO_4)_2$ in the slag and fixed therein.

While the above-described prior art has capabilities which are comparatively well suited for dephosphorization of molten pig iron and molten steels of ordinary composition, it is not applicable to processes for dephosphorizing metals and alloys containing more oxidizable elements than iron such as Cr, Si, Al, Mn and the like in an amount of about 4% or more based on the total weight of the metal or alloy, because these valuable elements tend to be oxidized in preference to phosphorus with the resulting yields of these elements being lowered. In addition thereto, as the oxidized portion of the molten metal is transferred to the slag, the dephosphorization is retarded to remarkably large extent physically as well as chemically. For this reason, it has been conventionally considered in the art that it is impossible to achieve a substantial level of dephosphorization of high chromium ferrous metals such as stainless steels and ferrochromium.

Recently, however, many efforts have been devoted to the investigation of effects of phosphorus involved as an impurities in metal materials, and it has been found that, particularly in the case of high chromium steels such as stainless steels, the phosphorus adversely affects the workability, corrosion resistance and weldability. In recent years, the increased phosphorus content in commercially available chrome ore and coke and the demand of lowered phosphorous contents in the final products leads to strong demand of making it possible to achieve the dephosphorization of the molten high chrome steel which has heretofore been impossible.

It is also known to use a plag containing metallic calcium along for the purpose of dephosphorizing a molten metal or molten alloy as disclosed in Japanese Laid-open Patent Specification No. 49-35213 and Japanese Patent Publication No. 51-2402. This method utilizes the following reaction:

$$3Ca(\text{in slag}) + 2P\ (\text{in metal}) \rightleftarrows Ca_3P_2\ (\text{in slag}) \quad (1)$$

so that the dephosphorization can be carried out without causing oxidation of the molten metal. When this method is applied to processes for refining molten metals on a large scale, however, certain drawbacks must be overcome. Metallic calcium is very expensive because of its low energy efficiency and productivity, and is also very reactive so that the handling of metallic calcium in large quantities is very troublesome.

SUMMARY OF THE INVENTION

The present invention is based on the discovery that calcium carbide when used in combination with one or more halides of an alkali earth metal has as high a refining effect as that of metallic calcium provided that the processing conditions are suitably controlled depending upon various factors which will be described in details later. In the following description, a refining agent comprising essentially calcium carbide and the above-identified halide prior to the addition to the molten metal will be hereinafter referred to as "flux", while "slag" will refer to the refining agent formed from the flux upon contact to the molten metal.

Although calcium carbide has so far found its use in a single form or in a combined form as a desulfurizing agent for treating molten iron and steel, molten ferroalloys and the like under the conditions well known in the art, the art of dephosphorization by use of calcium carbide has not so far been known.

The present inventors have clarified the conditions of the molten metal or alloy, the slag and the atmosphere for effective dephosphorization, and it has been found that the following requirements must be fulfiled for the commercial practice of the present invention.

(1) The molten metal to be treated should be in carbon-unsaturated conditions, because, when calcium carbide is added to the carbon-unsaturated molten metal, the following reaction takes place:

$$CaC_2\ (\text{in slag}) \rightarrow Ca\ (\text{in slag}) + 2C\ (\text{in metal}) \quad (2)$$

The metallic calcium in the slag reacts with the phosphorus in the molten metal according to the formula (1) to thereby effect dephosphorization of the molten metal. At the same time, the free carbon is dissolved into the molten metal. Therefore, the dephosphorizing treatment must be economically combined with suitable carbon adjustment before or after the dephosphorization.

(2) When the atmosphere under which the dephosphorization treatment is performed contains oxygen and/or nitrogen at high partial pressures, a large proportion of the once produced metallic calcium which is once produced in the slag is oxidized, as the following reactions based on formulae (3) and (4) prevail.

$$2Ca\ (\text{in slag}) + O_2 \rightarrow 2CaO\ (\text{in slag}) \quad (3)$$

$$3Ca\ (\text{in slag}) + N_2 \rightarrow Ca_3N_2\ (\text{in slag}) \quad (4)$$

For attaining effective dephosphorization, the refining must be performed under a severely controlled atmosphere on a commercial scale.

(3) Some of the produced metallic calcium is readily oxidized by oxygen in the molten metal and oxides deriving from the prior-stage slag, slagged refractory and the like. Thus, it is necessary to minimize the adverse effects of the oxygen and oxides.

(4) The slag formed by the flux of the present invention is very errosive to the refractory so that the treatment time involved must be shortened.

(5) As soon as the dephosphorization is finished, the slag must be separated from the molten metal, or otherwise phosphorus easily comes back into the molten metal.

(6) The discharged slag when cooled in the air, causes formation of deleterious gases such as phosphine through reaction with humidity in the air based on the following formula (5)

$$Ca_3P_2 \text{ (in slag)} + H_2O \text{ (in air)} \rightarrow 3Ca(OH)_2 \text{ (in slag)} + PH_3 \text{ (in air)} \quad (5)$$

Therefore, the discharged slag must be after-treated to prevent the formation of phosphine. This after-treatment will be hereinafter referred to as "stabilization of slag".

Accordingly, the present invention has for the general object to overcome all of the above mentioned drawbacks and to provide a method of dephosphorizing a large quantity of molten metal or alloy. The field of application of the method of the invention is not limited to a process for producing high chrome steels. In fact it is applicable to any process for producing a metal or an alloy containing elements more oxidizable iron with the phosphorus concentration being in an acceptable range.

The features of the present invention are as follows:

(1) A method of dephosphorizing a metal or alloy by use of a flux composition comprising calcium carbide and one or more halides of an alkali earth metal in a non-oxidizing atmosphere, wherein the metal or alloy contains a lower percentage of carbon than that corresponding to the carbon solubility.

(2) A method as described in paragraph (1) wherein the atmosphere is specified as $P_{O2}+P_{CO2}+P_{H2O}+P_{SO2}<60$ mmHg.

(3) A method as described in paragraph (1) wherein the atmosphere is specified so that the partial pressure of nitrogen is not more than 400 mmHg.

(4) A method as described in paragraph (1) wherein the flux composition includes 3–90% by weight of $CaC_2$ on the basis of the weight of the flux composition.

(5) A method as described in paragraph (1) wherein the flux composition includes metallic calcium Ca-Si-Mn, Ca-Si and/or Ca-Si-Fe alloys in an amount corresponding to 3 to 50% by weight as metallic calcium based on the total weight of the flux composition.

(6) A method as described in paragraph (1) wherein the oxygen concentration in a molten metal to be treated is adjusted to not more than 180 p.p.m. prior to the addition of the flux composition thereto.

(7) A method as described in paragraph (1) wherein the concentration of $CaC_2$ in the flux composition is controlled in accordance with the composition of the molten alloy to be treated and with a desired efficiency of dephosphorization, as expressed by the formula (6)

$$A \geqq \sqrt{\frac{\alpha\eta}{1.5(100-\eta)}}\ (4z^2 + x) \quad (6)$$

wherein

A: the concentration of $CaC_2$ in percent by weight based on the total weight of the flux composition;

$\alpha$: the ratio of the alloy weight to the flux composition weight;

$$\eta\text{: the efficiency of dephosphorization} = \frac{[P]a - [P]b}{[P]a} \times 100\%$$

wherein [P]a is the phosphorus concentration in the metal or alloy to be treated, and [P]b is the phosphorus concentration in the treated metal or alloy;

x: the conversion parameter of Ca produced by decomposition $CaC_2$ in the added flux composition, and $2.6 \leqq x \leqq 8.0$;

Z: the effective carbon concentration $=[\%C]\exp[-0.026[\%Cr] -0.03[\%Mo]-0.04[\%Mn]-0.12[\%Ti]-0.06[\%Nb]-0.05[\%V]- -0.015[\%W]$, wherein [%Cr], [%Mo], . . . , [%W] are the concentrations (percent by weight) of Cr, Mo, . . . , W in the metal or alloy to be treated, and [%C] is the concentration (percent by weight) of carbon in the treated metal or alloy, and wherein if the concentration (percent by weight) of carbon in the treated metal or alloy, and wherein if the concentration (percent by weight) of carbon in the metal or alloy to be treated is $[\%C]_0$, [%C] may be determined as $$[\%C] = [\%C]_0 + 0.306 \cdot x \cdot \sqrt{\frac{\eta}{\alpha(100-\eta)}}$$

(8) A process for producing a low phosphorus stainless steel comprising a first step of smelting a high chrome ferrous metal of carbon unsaturation, a second step of refining the molten metal by addition of a flux composition comprising calcium carbide and calcium fluoride in a non-oxidizing atmosphere, a third step of separating the molten metal and the slag thereby formed from each other, and a fourth step of performing finishing decarburization until the concentration of carbon in the resulting molten metal reaches a predetermined level.

(9) A process as described in paragraph (8), wherein the first step includes reduction of oxides of iron and chromium by a carbonaceous reducing agent to make a molten metal in which $Cr/Fe<1.0$, and subsequently to remove silicon from the molten metal.

(10) A process as described in paragraph (8) wherein in the third step the flux composition is added when the molten metal is transferred from the melting furnace to a molten metal receptacle, for example a ladle, of which the interior space is maintained in a non-oxidizing atmosphere, and only the dephosphorized molten metal is tapped out through a nozzle at a lower portion of the receptacle to effect the separation between the slag and the molten metal.

(11) A process as described in paragraph (8) wherein in the second step a tiltable reactor having a gas injection plug is used and is charged with the molten metal from the first step and then with the flux composition while stirring the molten metal charge by the bubbling with non-oxidizing gas blown through the gas injection plug to perform dephosphorization, and thereafter the layer of slag is oxidized by the blowing of an oxidizing gas as directed to the above of, or into the slag layer.

(12) A process as described in paragraph (8) wherein the second and the third steps are performed in such a manner that, after the slag covering the molten metal charge from the first step is pushed by a removable slag-layer breaker to expose the molten metal surface to the atmosphere, the flux composition is added to the molten metal charge through the atmosphere-exposed surface to perform dephosphorization, and thereafter the slag layer breaker is removed to permit the mixing of the slag from the first step with the slag formed in the second step.

(13) A method of treating the slag separated from the dephosphorized molten metal by reaction with another molten metal under an oxidizing atmosphere.

(14) A method of treating the slag separated from the dephosphorized molten metal by oxidation under an oxidizing atmosphere.

(15) A method of treating the slag separated from the dephosphorized molten metal of paragraph (14) by the oxidizing flame of a burner.

(16) A method of treating the slag separated from the dephosphorized molten metal by exposing it to an oxidizing atmosphere and then to an atmosphere containing 10% or more of $CO_2$ at a temperature ranging from 800° C. down to 300° C.

BRIEF DESCRIPTION OF THE DRAWINGS

FIG. 7 is a graph showing variation of the efficiency of dephosphorization relative to the oxygen gas concentration in the atmosphere.

FIG. 8 is a similar graph relative to the $CO_2$ and $H_2O$ gas concentrations in the atmosphere.

FIG. 30*a* shows the reactor state during the dephosphorization and FIG. 30*b* shows the reactor state during the slag stabilization.

DETAILED DESCRIPTION OF THE PREFERRED EMBODIMENTS

Figure 1:
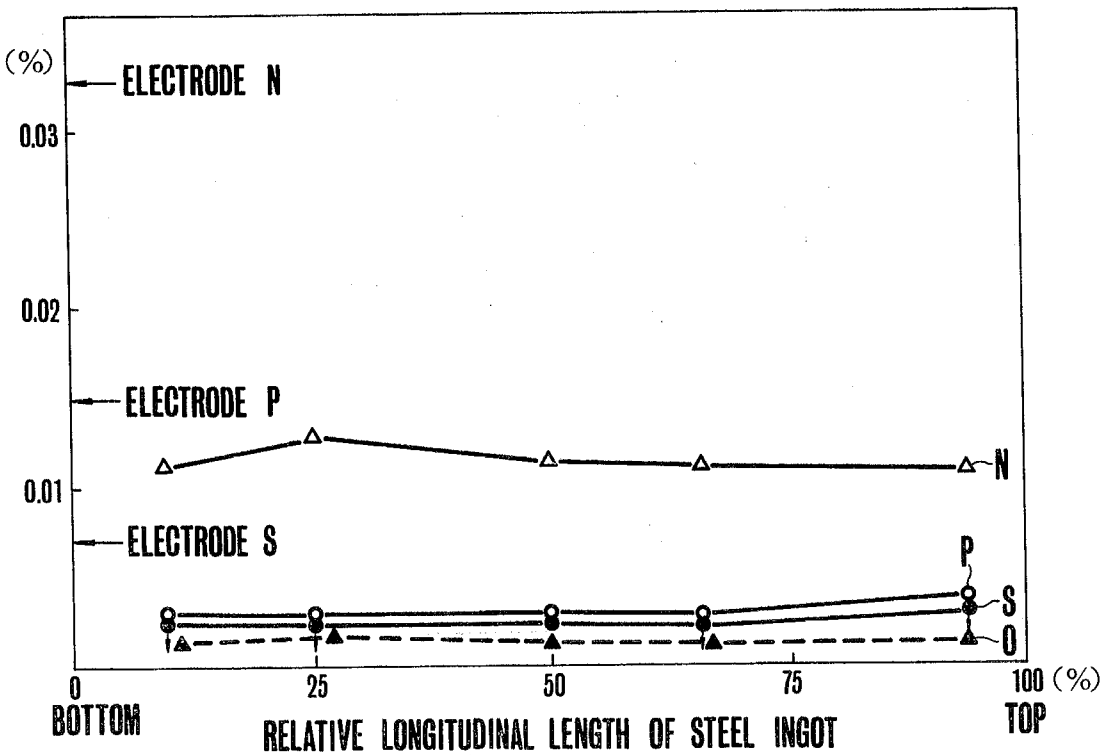
FIG. 1 is a graph showing the concentrations of nitrogen, phosphorus, sulfur and oxygen as impurities in a dephosphorized steel ingot at various points along the longitudinal length of the electroslag refined ingot and in which the concentrations of nitrogen, phosphorus and sulfur in the steel to be dephosphorized are indicated at electrode N, electrode P and electrode S respectively.
Figure 2:
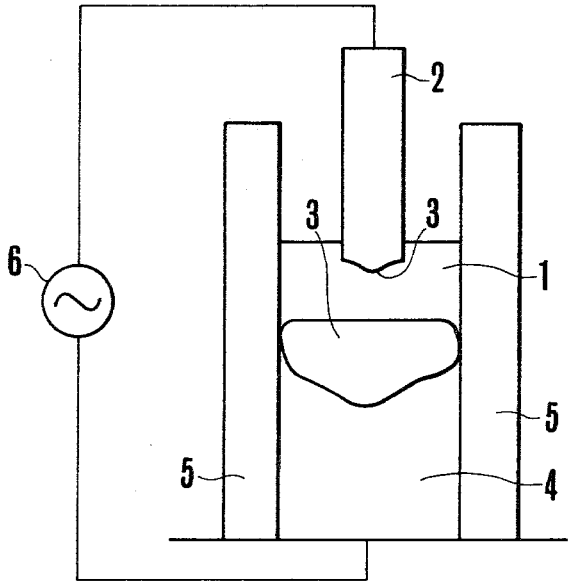
FIG. 2 is a schematic vertical sectional view of an electroslag refining apparatus for making the dephosphorized steel ingot of FIG. 1.

In accordance of the present invention, the flux composition, though functionable as a refining agent in a sence, is particularly adapted to the purpose of dephosphorizing a molten metal or alloy under carbon-unsaturated conditions, being characterized by comprising calcium carbide and one or more halides of an alkali earth metal. As has already been described in connection with formula (2), upon contact with the molten metal, the calcium carbide decomposes to produce metallic calcium which is then acted on phosphorus in the molten metal to effect dephosphorization, provided that the concentration of calcium carbide in the flux composition is 3% or more, because of the occurrence of the reverse reaction of formula (2). The higher the concentration of calcium carbide in the flux composition, the larger the percentage of phosphorus removed, but increased concentrations of calcium carbide result in an increase of the melting point of the flux composition and the slag viscosity. In case of the electroslag refining where the slag is required to be completely melted, the upper limit of a compositional range of calcium carbide is 60%, preferably the ratio $CaC_2/CaF_2$ in the slag is from 0.05 to 1.0 (5–50% $CaC_2$ in the slag). On the other hand, when an oxide type refractory lined receptacle is employed to treat the molten metal, it is not necessary to melt completely the slag, so that the upper limit of $CaC_2$ concentration may be higher but if the concentration exceeds 90%, the slag does not melt almost at all, resulting in lowered efficiency in removal of the impurities. Thus a preferable upper limit of the concentration of calcium carbide is 90%. Therefore, in order to prevent refractory attack by the slag and to attain effective dephosphorization, it is preferable that the ratio of $CaC_2/CaF_2$ in the flux is from 5 to 0.25 (20 to 80% $CaC_2$ in the flux). When the concentration of calcium carbide in the flux composition is relatively high with the resulting slag being in a semi-molten state, it is preferred to agitate the dephosphorizing system.

The alkali earth metal halide in the flux composition is the most effective constituent for controlling the melting point and fluidity of the slag to promote the interaction between the slag and the molten metal, and further functions as an essential constituent for retaining the calcium compounds produced by dephosphorization based on formula (2) as well as the metallic calcium produced based on formula (1) in the slag phase. As examples of such alkali earth metal halide, mention may be made of $CaF_2$, $MgF_2$, $BaF_2$, $CaCl_2$ and $MgCl_2$. Of these halides, it is most preferable to use $CaF_2$ because of its chemical stability at high temperatures. If the desired results of the invention are to be attained, it is required that the concentration of one or more halides of an alkali earth metal in the flux composition be not less than 10%.

When the flux composition of the invention is formulated by use of a commercially available carbide as the $CaC_2$-sourcing material, it is unavoidable to introduce a certain amount of calcium oxide into the resulting flux composition. Also a part of calcium carbide is converted to calcium oxide by oxidation. Calcium oxide, though not essential for the invention is not so harmful as other oxides, and acts in an effective manner to adjust the melting point and viscosity of the slag. According to the need, 10% or more of calcium oxide may be added to assist in preventing the refractory erosion. If the concentration of calcium oxide is too much high, however, the concentration of calcium carbide lowers and the viscosity of the slag increases so that the dephosphorizing effect is remarkably hindered and it is required that the upper limit of the calcium oxide concentration be 50%.

The slag may include oxides such as silica, alumina, iron oxide, manganese oxide and titanium oxide, but their total amount is preferably limited to as small a level as possible, namely, less than 20%, or otherwise the calcium carbide and metallic calcium in the slag are oxidized.

The degree of formula (1) reaction is largely dependent upon the difference between the actual carbon content and carbon solubility in a molten metal being refined. The larger the difference, the larger the amount of calcium produced, resulting in an increased degree of dephosphorization. When the molten metal is in carbon-saturated conditions, no dephosphorization takes place. If the flux composition is formulated by using calcium carbide only as the metallic calcium source, the carbon concentration of the metal and alloy to be treated must be lower than the carbon solubility. On the other hand, in order to effect equivalent dephosphorized results, as the difference between the actual carbon content and the carbon solubility of the molten metal increases, the concentration of calcium carbide in the flux composition may be decreased. It is to be noted that, as the dephosphorization proceeds, the carbon content of the molten metal is increased as can be seen from formula (2).

When the carbon content of a molten metal to be treated is not so much lower than that corresponding to the carbon solubility in the metal, or when it is desired that the carbon content increase of the dephosphorized metal is limited to a certain level, the flux composition may be formulated as including metallic calcium or calcium alloy such as Ca-Si, Ca-Si-Fe and Ca-Si-Mn along with calcium carbide. In this case, upon addition to a molten metal, the calcium alloy is decomposed with only the calcium being retained in the slag layer and with other elements than calcium being transferred to the molten metal. By this retained calcium, the decomposition of $CaC_2$ is retarded to prevent the carbon content of the molten metal from being increased. This retained calcium also functions as the dephosphorizing agent. The higher the concentration of metallic calcium or calcium alloy in the flux composition, the higher the rate of dephosphorization, but too much high concentration will lead to large rate of evaporation of calcium so that the calcium can not be effectively utilized. Further, upon reaction with carbon in the molten metal, $CaC_2$ is produced, thus contributing no effect to the dephosphorization. To achieve better utilization of the added calcium for dephosphorization, it is found that the optimum range of concentration of metallic calcium and/or calcium alloy in the flux composition is such that the percentage of calcium reduced therefrom is 3 to 50% as calcium based on the total weight of the resultant flux composition.

Figure 5:
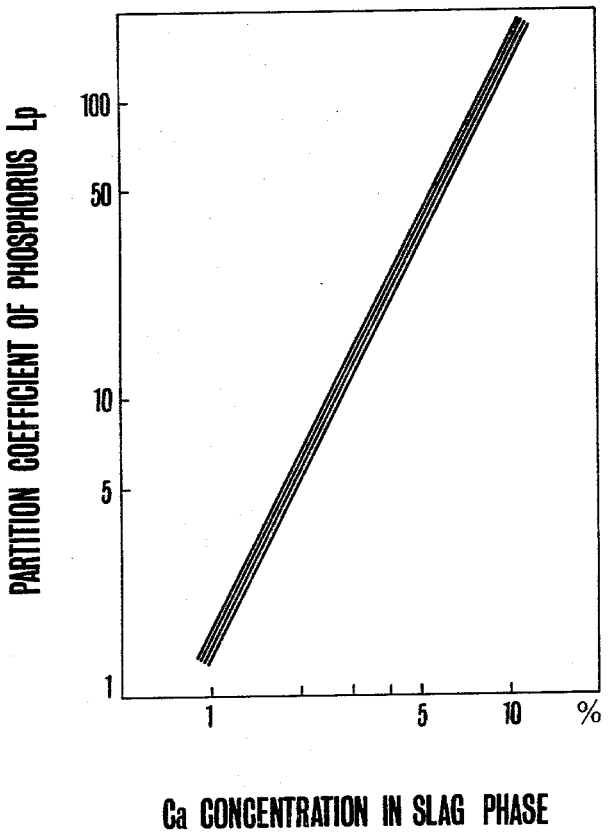
FIG. 5 is a graph showing the dependence of the partition coefficient of phosphorus in the slag on the concentration of calcium therein.
Figure 6:
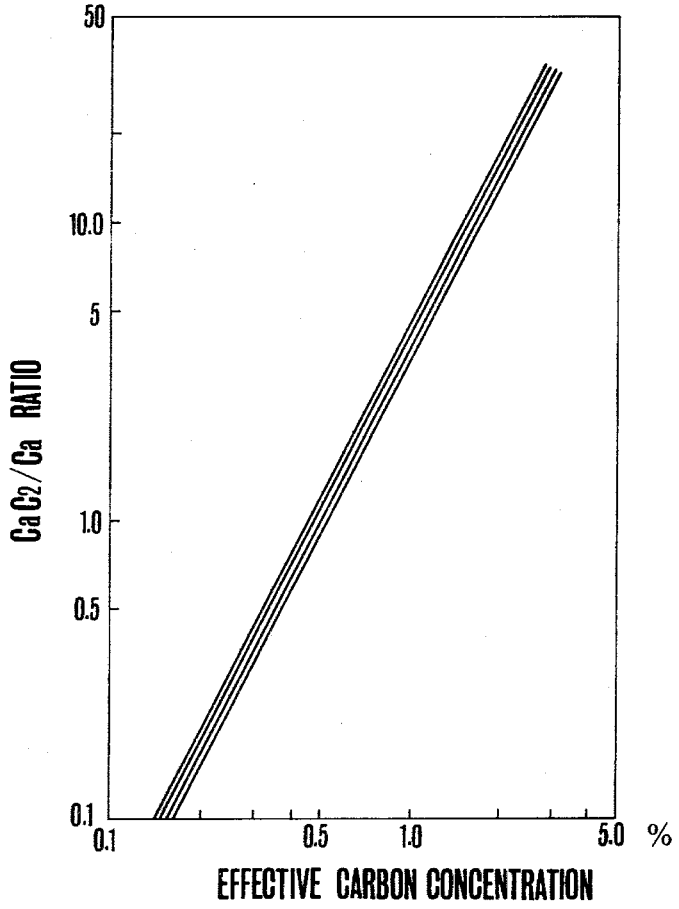
FIG. 6 is a graph showing the dependence of the ratio $CaC_2/Ca$ on the effective carbon concentration as defined by the variable z in formula (6).

The background of defining the compositional range of calcium carbide has been described above, but this leads to no preliminary evaluation of the efficiency of dephosphorization. In this respect, the present inventors have conducted experiments and found that there is clear relation between the concentration of calcium in the slag and the partition coefficient Lp of phosphorus as depicted in FIG. 5, wherein the curve may be approximated by the following equation $$Lp = 1.5[Ca]^2 \quad (7)$$

and further that the ratio of the calcium carbide concentration to the calcium concentration in the slag is a function of the effective carbon concentration (z) dependent upon the composition of the molten metal, as shown in FIG. 6. These relations are valid independently of the formulation of the flux composition, the kind of molten metal or alloy, and dephosphorizing processes. By introduction of a conversion parameter, x, for evaluating the conversion of $CaC_2$ to Ca, the present inventors have derived the following formula (6) based on which the lower limit of the concentration of $CaC_2$ in the flux composition can be determined to effect dephosphorization at a desired or preliminary evaluated efficiency $\eta$.

$$A \geqq \sqrt{\frac{\alpha\eta}{1.5(100-\eta)}}\,(4z^2 + x)\ 2.6 \leqq x \leqq 8.0 \quad (6)$$

wherein the parameters, x, and $\alpha$, and the variable, z, A and $\eta$ are previously defined.

In practicing the invention, it is of very importance to specify the atmosphere. The presence of oxidizing gases such as of oxygen, air, $CO_2$, $H_2O$ and $SO_2$ in the atmosphere causes a large proportion of the calcium carbide and metallic calcium in the slag to be oxidized, resulting in a remarkable decrease in the power of the slag for dephosphorization. Further, the once produced compound of metallic calcium and phosphorus is decomposed again upon reaction with the oxidizing gas and the phosphorus is then allowed to come into the molten metal or alloy. Such a situation is depicted in FIGS. 7 and 8, wherein curves representing variations of the efficiency of dephosphorization relative to the oxygen gas concentration as well as the combined carbon dioxide and water gas concentration respectively show sharp increase at a region from 7 to 9%. According to the invention, therefore, the atmosphere under which the dephosphorization is performed is specified either as the sum of the percentages by volume of one or more oxidizing gases such as oxygen gas, carbon dioxide gas sulfur dioxide gas, water vapor and the like is less than 8%, or as the sum of the partial pressures of one or more of the above-identified gases is less than 60 mmHg.

Figure 12:
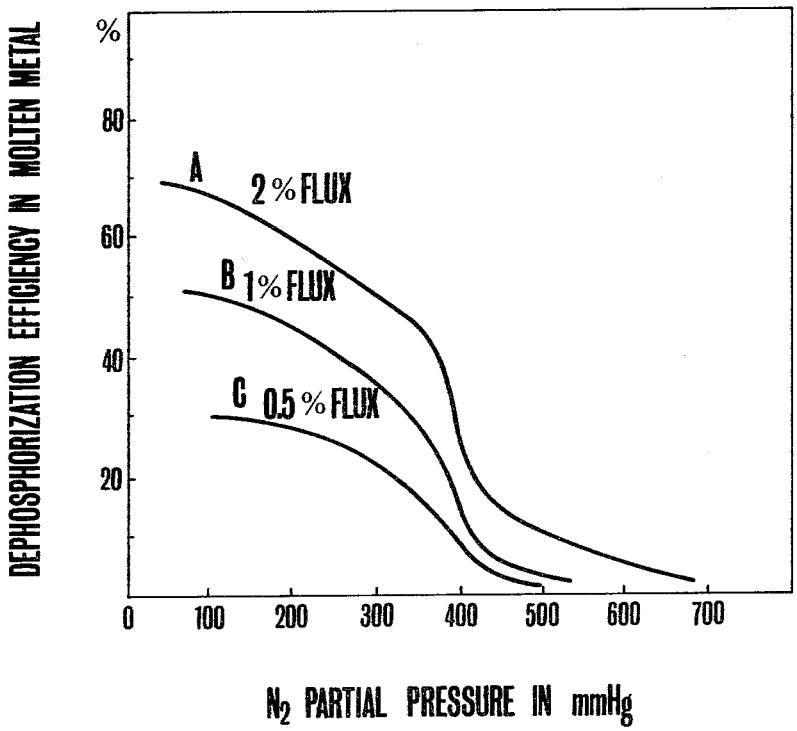
FIG. 12 is a graph showing variation of the efficiency of dephosphorization effected by use of a flux composition comprising $CaC_2$ and $CaF_2$ as a function of the partial pressure of nitrogen gas in an argon atmosphere, with the parameter being the percentage of the flux composition based on the total weight of the molten metal.
Figure 13:
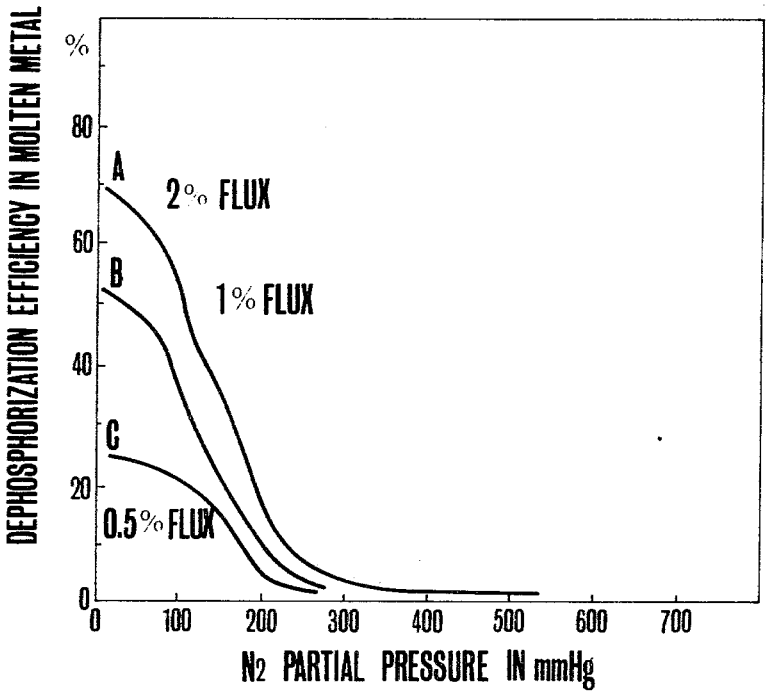
FIG. 13 is a similar graph with the partial pressure of nitrogen coming from the air.

The maintenance of the oxygen gas partial pressure of the refining atmosphere below the above specified level does not always lead to the expected results of dephosphorization differing from heat to heat. Various experiments indicate that the nitrogen gas in the atmosphere has some adverse influence. FIG. 12 shows the dependence of the dephosphorization efficiency on the nitrogen gas partial pressure, as the refining atmosphere is controlled by the supply of mixed gases $Ar+N_2$ in controlled proportions. As the partial pressure of nitrogen gas in the atmosphere increases, the efficiency of dephosphorization is decreased sharply in the individual curves A, B and C beginning at about 400 mmHg. This is because the nitrogen reacts with a corresponding proportion of the metallic calcium in the slag according to formula (4). According to the invention, the atmosphere including nitrogen gas is specified as the partial pressure of nitrogen gas is not more than 400 mmHg, provided that no oxygen gas coexists with the nitrogen gas. It is preferred to decrease the partial pressure of nitrogen gas to less than 200 mmHg. If the presence of nitrogen gas in the atmosphere is due to the entrance of air from the outside of the system, there are additional adverse effects by oxygen gas so that the acceptable level of partial pressure of nitrogen gas is further lowered as shown in FIG. 13. When the supply source of nitrogen gas is the air, therefore, it is required to limit the partial pressure of nitrogen gas to less than 200 mmHg and preferably to less than 100 mmHg.

Figure 9:
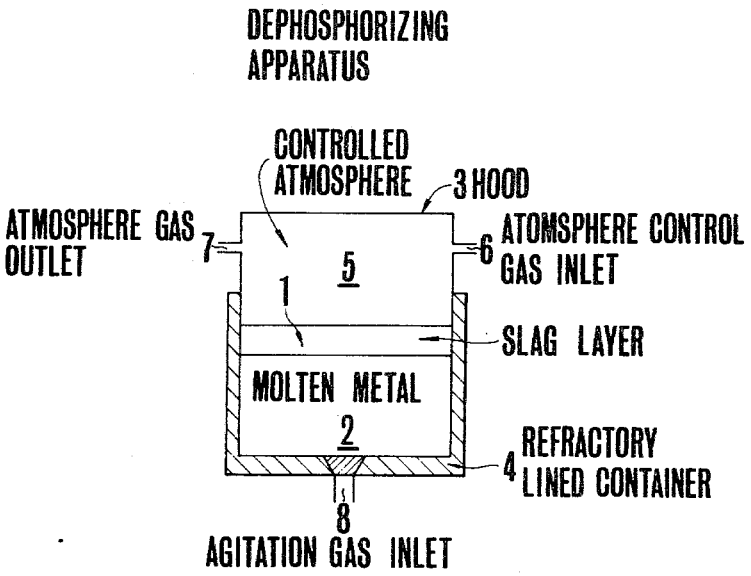
FIG. 9 is a vertical sectional view of an example of the air-tight sealed unit usable in the method of the invention.
Figure 10:
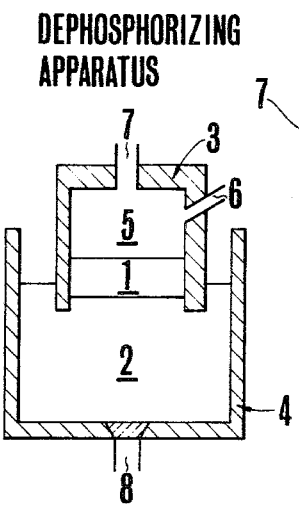
FIG. 10 is a similar view of another example of the unit.
Figure 11:
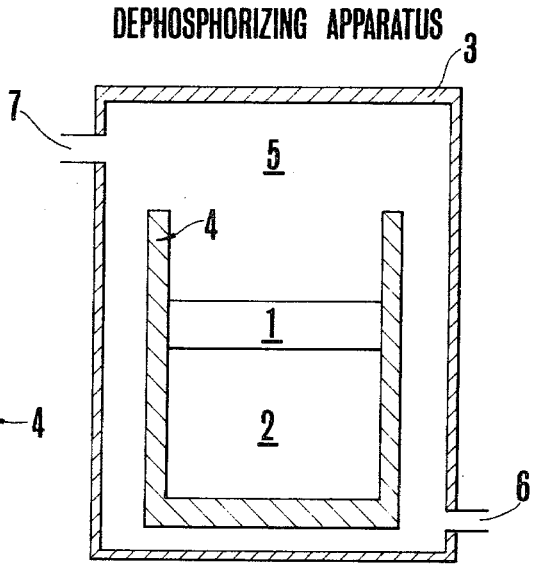
FIG. 11 is a similar view of still another example of the unit.

To attain the above mentioned atmosphere conditions, there are various methods such as supplying one or more inert gases such as argon gas and helium gas, or reductive gases such as hydrocarbon gas and natural gas into the interior of a receptacle, and the molten metal receptacle may be provided with an air-tight sealed apparatus, three examples of which are shown in FIGS. 9, 10 and 11.

Figure 14:
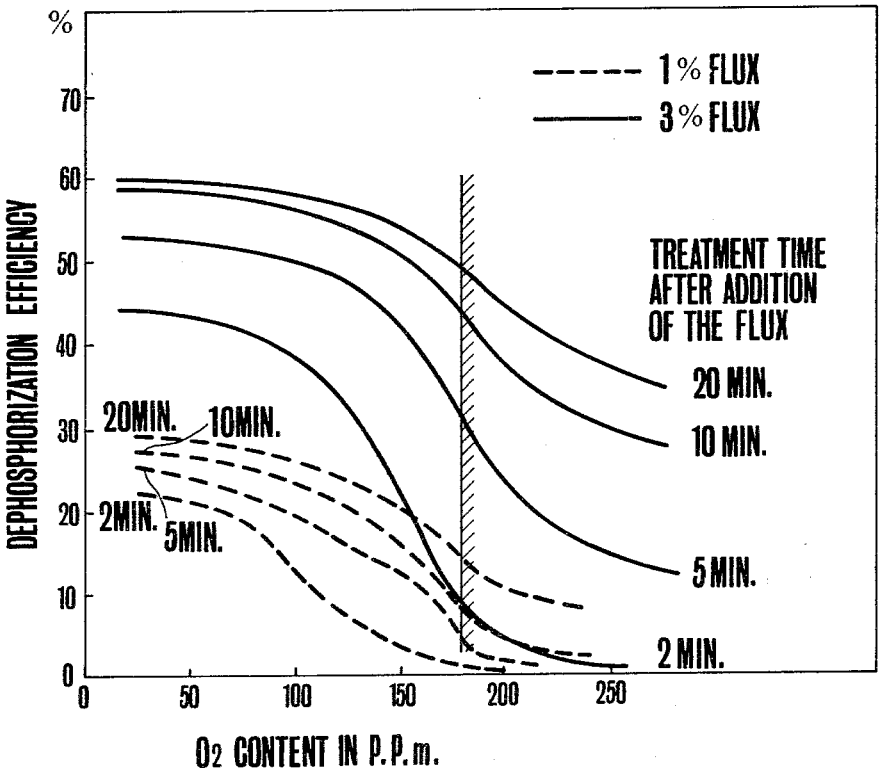
FIG. 14 is a graph showing variation of the efficiency of dephosphorization of a molten 18%Cr-8%Ni-0.7%C crude stainless steel treated with a flux composition comprising 70% of calcium carbide and 30% of purified fluorite as a function of the concentration of oxygen in the steel as measured before the treatment, with a parameter being the treatment time and with another parameter being the percentage of the flux composition based on the total weight of the molten metal.

The present inventors have found from the following experiments that it is important to adjust the oxygen content of a molten metal or alloy to not more than 180 p.p.m. prior to the addition of the flux composition. In the experiments, a crude stainless steel of 18%Cr-8%Ni-about 0.7%C was melted in a high frequency induction furnace and then charged with various additions of aluminum to prepare a number of molten metals of different oxygen content ranging from 30 to 250 p.p.m. These metals were treated with a flux composition comprising 70% of calcium carbide and 30% of purified fluoride. Specimens were taken from the metals at 2, 5, 10 and 20 minutes after the addition of the flux composition, and were analyzed for phosphorous contents. The results are shown in FIG. 14, wherein each of eight curves representing variation of the efficiency of dephosphorization relative to the initial oxygen content of the molten metal show sharp decrease at about 180 p.p.m., and wherein the efficiency of dephosphorization at an early stage in a treatment time of 2 to 5 minutes is particularly affected by the oxygen content. This is because when the oxygen content of the molten metal is relatively high, the following reactions take place.

$$CaC_2(\text{in slag}) + 3O(\text{in metal}) \rightarrow CaO(\text{in slag}) + 2CO \quad (8)$$

$$Ca(\text{in slag}) + O(\text{in metal}) \rightarrow CaO(\text{in slag}) \quad (9)$$

As a result, the concentrations of calcium carbide and metallic calcium in the slag are decreased, while the concentration of calcium oxide is increased. The decrease of the metallic calcium concentration leads to direct inhibition of the proceeding of the dephosphorization. On the other hand, as the concentration of calcium oxide is increased, the calcium carbide is correspondingly diluted particularly at the interface between the slag layer and the molten metal. As the distribution of calcium oxide is maximum in the vicinity of the interface, the proceeding of the dephosphorization is retarded. With elapse of time, the refractory erosion becomes appreciable to effect a decrease in the driving force for dephosphorization. Therefore, when the efficiency of dephosphorization in the early stage is small, it is impossible to achieve dephosphorization to the final stage at a high efficiency. Another disadvantage is that as the amount of that portion of the slag which is oxidized by the oxygen in the molten metal being treated is increased, it is of course necessary to increase the amount of the flux composition used to effect equivalent efficiency of dephosphorization. The flux composition of the invention is, however, characterized by its strong affinity to the oxide type refractory. In this respect, it is of importance to shorten the treatment time, and it is a new finding that the dephosphorization speed largely depends upon the oxygen content of the molten metal. In accordance with the invention, therefore, the oxygen content of a molten metal or alloy to be dephosphorized is adjusted to not more than 180 p.p.m., and preferably to not more than 100 p.p.m. prior to the addition of the flux composition to the molten metal. Further experiments indicate that this limit value of the oxygen content is hardly affected by nickel and chromium contents in the molten metal when their concentrations are varied from 0% to 20% and 4% to 70% respectively.

In practice of the present invention, the molten metal or alloy may be brought into contact with the slag in various ways, such as in a remelting furnace, such as in an electroslag remelting furnace, an arc remelting furnace and a plasma remelting furnace, in a casting mold, or in refractory receptacle such as a ladle and a melting furnace. Among these, it is most economical on a commercial scale to perform the contact in the refractory receptacle.

The present invention will be further illustrated as applied to a process for making a low phosphorus stainless steel in a refractory receptacle. The process for producing a low phosphorus stainless steel by employing the method of the invention comprises a first step of melting a high chrome ferrous metal under carbon-unsaturated conditions, a second step of dephosphorizing the molten metal by addition of a flux composition comprising calcium carbide and calcium fluoride in a non-oxidizing atmosphere, a third step of separating the molten metal and the slag from each other, and a fourth step of performing finishing decarburization until the concentration of carbon in the resulting molten metal reaches a predetermined level, each step of which will be explained in detail below.

Figure 16:
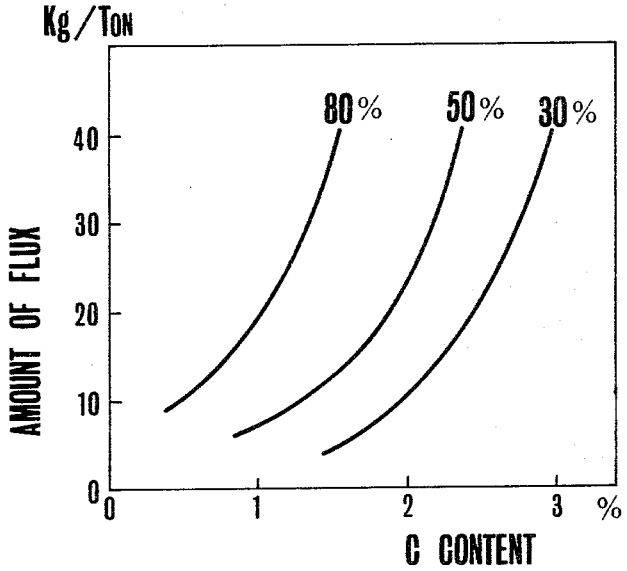
FIG. 16 is a graph showing variation of the necessary amount of a flux composition comprising 50%$CaC_2$, 15%CaO and 30%$CaF_2$ with which a high chrome steel with a chrome content of 16 to 20% is to be dephosphorized at a desired efficiency as a function of the carbon concentration in the metal.

The 1st step: Using a steel making furnace operating under the atmospheric air pressure, a molten ferrous metal containing chromium in a concentration almost equal to that in the final product is prepared. The material charged into the furnace may be commercially available one. In the case of the electric furnace, a large portion of the material is scrap, ferrochromium, and, if necessary, a nickel source. In the case of the converter, a large percentage of the material is pig iron, ferrochromium and, if necessary, a nickel source. The iron source itself is desirably dephosphorized before the chromium source is added thereto. Particularly when pig iron is used as the iron source, it must be dephosphorized by oxidizing refining before charged together with the ferrochromium and other necessary ingredients into the furnace in which all of these ingredients are mixed and melted. For facilitating operation of the subsequent steps, it is preferred to decarburize the molten alloy in the furnace by means such as of oxygen blowing to a point where an excess proportion of the chromium is not oxidized as the operation is performed under the atmospheric air pressure, or otherwise the necessary percentage of the flux composition which is to be used in the second step would be increased as can be seen from FIG. 16. In practicing the invention, the lower the carbon content of the molten alloy supplied from the first step, the better the results. In general, the decarburization to less than 0.2% under the atmospheric air pressure leads to excessive oxidation of chromium. Accordingly, the decarburized molten alloy charge may include carbon in a range of 0.2 to 2%.

The second step: The carbon-unsaturated high chrome molten alloy from the first step is dephosphorized in contact with the flux composition containing calcium carbide and calcium fluoride as the essential constituents under non-oxidizing atmosphere. To achieve dephosphorization at a high efficiency by increasing the rates of the reactions of formulae (1) and (2), the loss of metallic calcium by oxidation due to the accompanied slag and the oxidizing gases in the refining atmosphere must be inhibited. At first, the accompanied oxidizing slag from the first step must be removed in as large a proportion as possible. To separate the slag from the molten alloy, in the case of the electric furnace, the furnace is tilted to a point at which the slag can be pulled out while leaving the molten alloy behind the furnace. In the case of the converter, the molten alloy tapping spout may be provided with means for preventing the flow of the slag through the spout, for example, a slag ball, or sliding nozzle. When the oxidizing slag can not be fully taken off from the molten alloy, a certain amount of a deoxidizing agent such as Ca-Si, Fe-Si or Al may be added to reduce the oxidizing ability of the slag. Secondly, it is of importance to avoid the invasion of oxidizing gases for the atmospheric air into the refining system to as small a limitation as possible.

After the above-described requirements have been satisfied, the molten alloy is charged with the flux composition in either of two manners (A) and (B) to achieve efficient dephosphorization.

Figure 17:
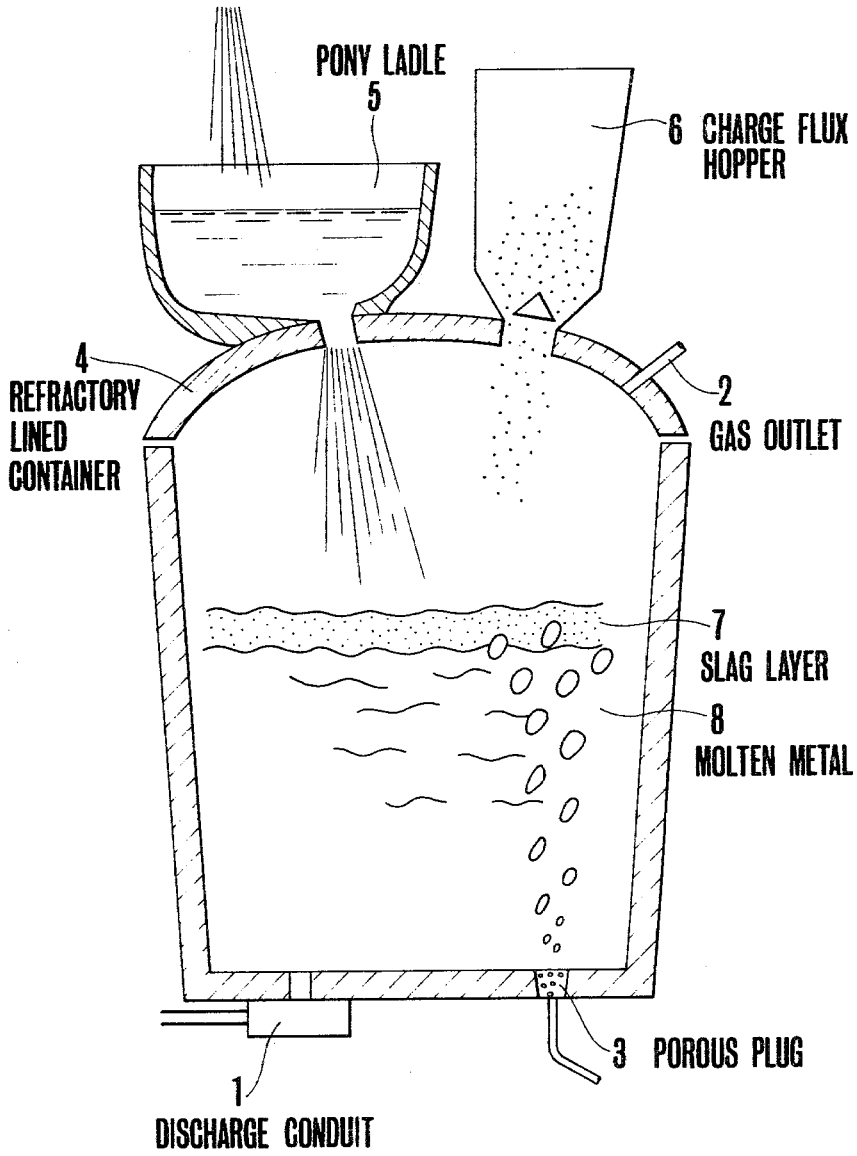
FIG. 17 is a vertical sectional view of an example of the dephosphorizing apparatus usuable in the method of the invention.

(A) The flux composition is added at a time when the molten alloy is tapped into a receptacle of air-tight sealed, whereby the molten alloy stream ensures good mixing of the flux composition with the molten alloy. Therefore, there is no need to provide particular stirring means for increasing the interaction between the slag and the molten alloy. The utilization of the molten alloy stream leads to the shortening of the dephosphorization time. As the flux composition of the invention includes a large percentage of calcium fluoride, the shortening of the time is very significant because the receptacle lining refractory erosion can be reduced to remarkable extent. In order to avoid the invasion of air into the interior of the receptacle from the outside thereof, the molten metal receptacle may be provided with a pony ladle arranged as shown in FIG. 17 to receive the molten alloy from the melting furnace of the first step before transported to the receptacle. Alternatively, the receptacle may be provided with atmosphere-control gas inlet and outlet through which an inert gas or reducing gas is supplied into the interior of the receptacle. In order to increase the interaction between the flux composition-converted slag and the molten alloy, an argon gas jet may be applied to the tapping flow of the molten alloy from the melting furnace, thereby the molten alloy is sprayed to increase the specific surface area thereof with increase in the interaction therebetween. Alternatively, the molten alloy may be subjected to a degassing vacuum as it is transferred from the melting furnace through the pony ladle into the receptacle which is previously evacuated, thereby gas is evoluted from the molten alloy into the vacuum environment, causing the molten alloy to be divided into droplets. In any case, the flux composition may be added in portions successively.

(B) After the molten alloy is transferred from the melting furnace into the receptacle, the flux composition is added in whole or in parts to the molten alloy in the receptacle while preventing the invasion of air, and then the flux composition and the molten alloy are stirred. As a starting method, an inert gas such as argon may be blown into the molten alloy. The thereby used gas serves to make the atmosphere non-oxidizing. The flux composition in a finely divided form may be added as carried away with the agitation gas to promote the interaction. When a large percentage of the flux composition is used to result in a large drop of the temperature of the molten alloy, it is preferred to employ heating means. The use of arc as a heat source makes oxygen gas and nitrogen gas activated to affect the reaction in a large degree even when the concentrations of oxygen gas and nitrogen gas in the refining atmosphere are very small. To minimize this affection, it is desirable to use hollowed electrodes through which an inert gas such as argon can be supplied to the arc zone.

The third step: After the dephosphorization has been finished, the slag is separated from the dephosphorized molten alloy. Because of a high probability of giving an opportunity for the occurrence of rephosphorization which is generally encountered when the refining atmosphere is rendered oxidizing, it is desirable that the slag be separated from the molten alloy. Such a separation can be carried out by use of the conventional slag removing method. In addition thereto, there is another method wherein the receptacle is provided with a nozzle arranged at the bottom thereof upon opening to cause the tapping of the molten alloy. Just before the slag is tapped through the nozzle, it is closed to leave the slag in the receptacle. The isolated slag when exposed to the air produces toxic gases such as $PH_3$, $H_2S$, and acetylene as a result of reaction with the humidity in the air. Therefore, it must be stabilized in a manner to be described in detail later.

The fourth step: As the molten metal supplied from the third step contains carbon in a higher concentration than that of the final product because of the occurrence of recarburization to 0.1 to 0.8% in the second step, decarburization to a predetermined carbon content level must be carried out by the conventional vacuum oxygen blowing method, or Ar-$O_2$ bottom blowing method.

It will be appreciated that the present invention provides a method for dephosphorization by use of a flux composition containing calcium carbide and calcium fluoride as the essential constituents which method is particularly adapted for use in a process for making stainless steel on an industrial scale, while overcoming the problem of picking up carbon by the molten metal due to the use of comparatively cheap calcium carbide as the metallic calcium source without sacrificing the advantages of the conventional steel making process. The dephosphorization is accompanied by desulfurization so that it is possible to eliminate the desulfurizing step for the molten ferrochromium, or molten stainless steel.

As one method of making stainless steels, it is known to use a high chrome ferrous metal obtained by reducing ore and iron ore together. In the case of $Cr/Fe < 1.0$, it is possible to perform the reduction in a blast furnace, thereby giving a merit of decreasing the energy cost. The molten metal thus prepared may be subjected to dephosphorization in the above described second step provided that the carbon content of the molten metal is made lower than that corresponding to the carbon solubility by a suitable method. This object can be attained by decarburization, but it can be attained also merely by lowering the silicon content even without decarburization. As the silicon in the molten metal tends to increase the activity coefficient of carbon, the lower the Si content, the higher the solubility of carbon in the molten metal. In other words, when the Si content is decreased, the difference between the actual carbon content and the carbon solubility in the molten metal is increased. There are practically usuable two methods of decreasing the Si content;

(1) The application of oxygen gas, or the addition of oxide to remove Si as $SiO_2$.

Figure 15:
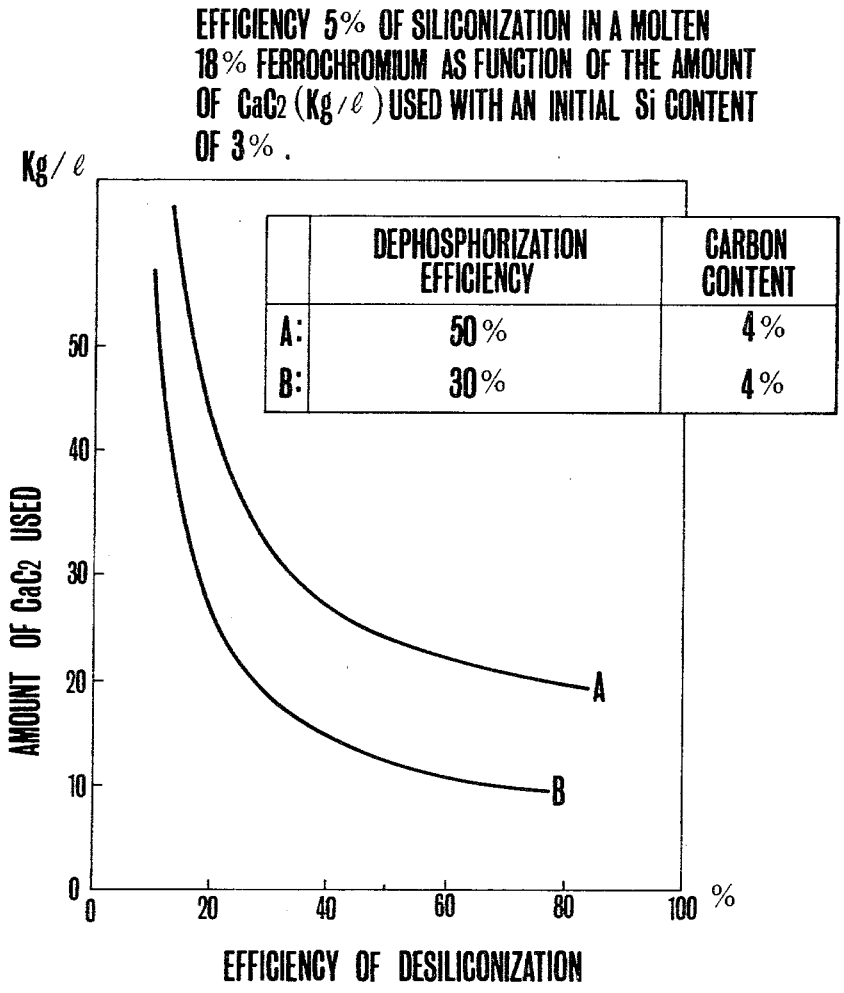
FIG. 15 is a graph showing variation of the necessary concentration of calcium carbide in a flux composition with which a 4%C-18%Cr-Fe is to be dephosphorized at a desired efficiency as a function of the degree of silicon removable from the alloy with the initial Si content of 3%, with a parameter being the efficiency of dephosphorization.

(2) The addition of low Si content scrap or ferroalloy for dilution. The larger the decrease in Si concentration, the lower the cost of the dephosphorizing flux composition. As shown in FIG. 15, it is preferred to perform silicon removal from the molten metal at a higher degree than 30%. If decarburization takes place along with the desiliconization, the difference between the actual carbon content and the carbon solubility will correspondingly increase. Accordingly, if permissible with the given apparatus, the decarburization may be carried out. It is to be noted that when the Si content is decreased by use of the method (1), the slag containing a large percentage of $SiO_2$ is desirably removed from the molten metal before it is subjected to dephosphorization in the second step.

Figure 30:
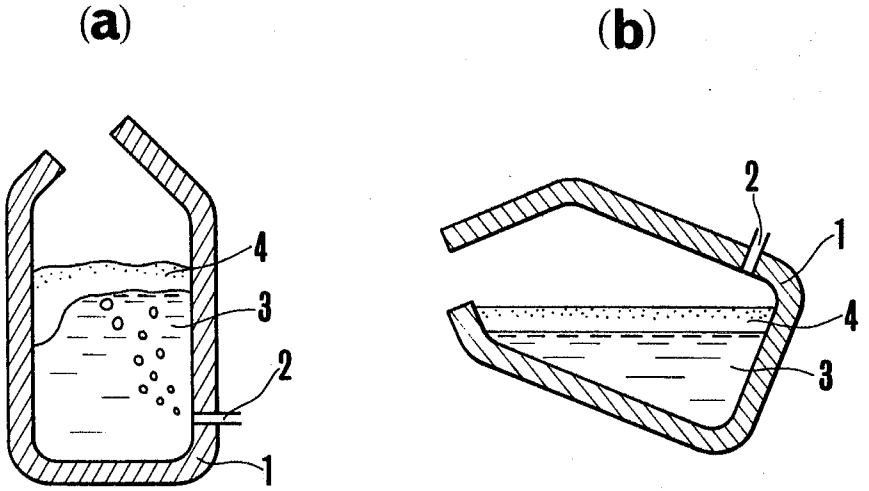
FIG. 30 shows one embodiment of the dephosphorization using a tilting-type reactor.

The operation of the second step can be advantageously carried out when the molten metal holding receptacle is of the tippable type as shown in FIG. 30, provided that the second step includes an after-treatment of the waste slag for stabilization against the formation of undesirable gases therefrom. At first, the receptacle 1 disposed in a normal operating position shown in FIG. 30(*a*) is charged with the molten metal 3 followed by the addition of the flux composition with stirring by a non-oxidizing gas such as argon blown into the molten metal 3 through a gas inlet 2 provided in the side wall of receptacle 1 at a location near the bottom thereof, while the receptacle interior space above the molten metal 3 and later a slag layer 4 being filled with a non-oxidizing gas. After the dephosphorization has been finished, the receptacle 1 is tilted to a point where the molten metal 3 is not drained from the receptacle beneath the slag layer 4, but the gas inlet 2 is communicated with the space above the slag layer 4. Thereafter, an oxidizing gas such as oxygen, argon-oxygen, or air is blown through the inlet 2 onto the slag layer 4 to oxidize the slag. In this case, additional gas inlet means may be employed to apply the oxidizing gas either onto or into the slag layer 4. This system has an advantage of requiring no auxiliary apparatus for stabilizing the waste slag while maintaining the rate of rephosphorization at minimum.

Figure 18:
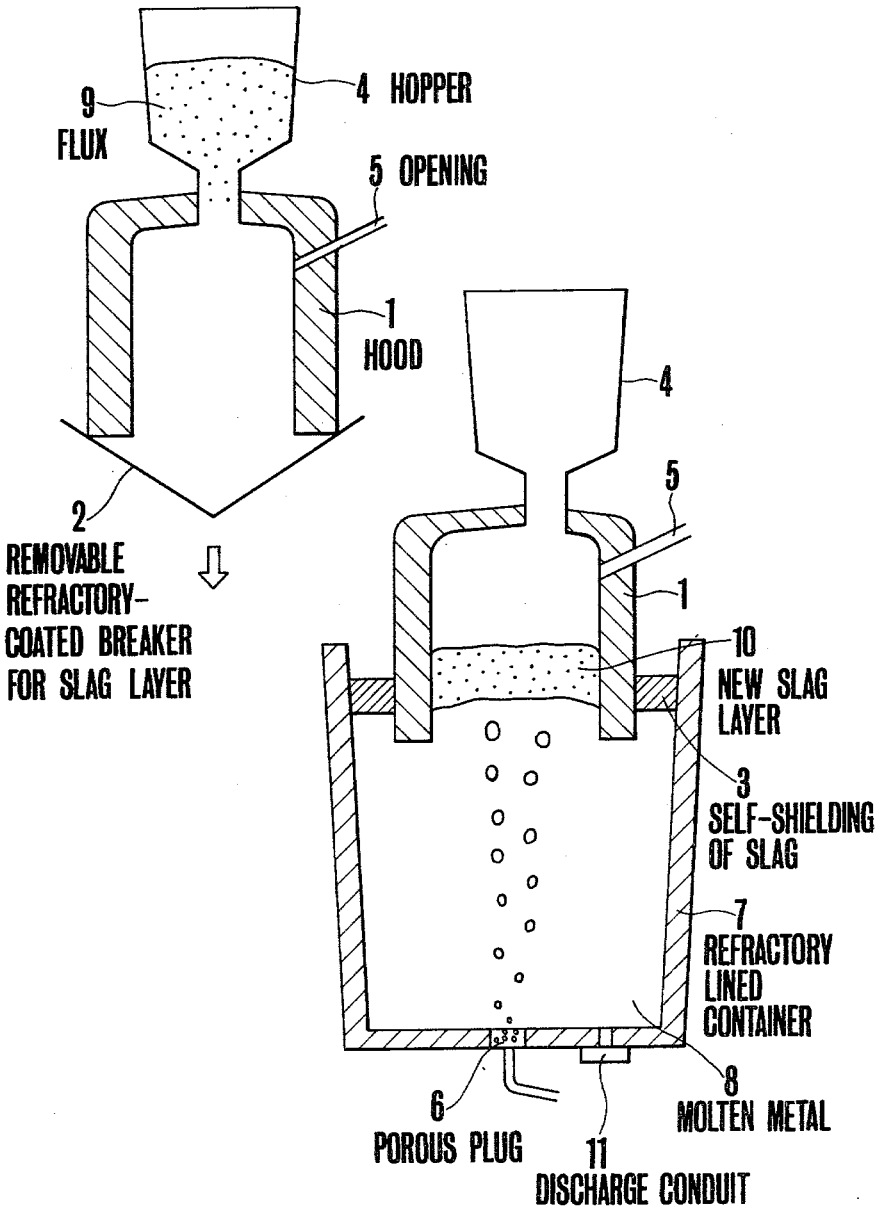
FIG. 18 is a vertical sectional view, partly schematic, of an example of the dephosphorizing apparatus cooperative with a slag layer breaker.

When the first step includes oxidation treatment of a molten metal or alloy for lowering the carbon content thereof below the carbon solubility level, the slag thereby produced is very oxidizing. Although a large proportion of the oxidizing lag can be removed from the molten metal before transferred to the second step, it is very difficult to achieve 100% removal of the slag economically. Even when the remaining slag transferred to the second step is small in quantity, a large proportion of the calcium carbide and metallic calcium in the flux composition of the invention when added to the molten metal supplied from the first step is oxidized wastefully by oxidation to result in a remarkable decrease in the efficiency of dephosphorization. In order to avoid such situation, the second step may be operated with an auxiliary apparatus for applying the flux composition to the molten metal supplied from the first step while preventing the added flux composition from being brought into contact with the oxidizing slag coming from the first step as shown in FIG. 18. The flux applying apparatus comprises a refractory-coated airtight shield hood 1, a slag layer breaker 2 attached on the hood 1 at the bottom thereof, a flux charge hopper 4 fixedly mounted on the hood 1 at the top thereof and a gas inlet 5. After a receptacle 7 is charged with a molten metal 8 from the first step along with the unavoidably accompanied oxidizing slag 3, the flux applying apparatus is inserted from the above onto the receptacle 7, while the oxidizing slag 3 being pushed toward the side wall of the receptacle 7 by the breaker 2. After the open end of the hood 1 reaches a sufficient depth below the molten metal level, the breaker 2 is melted to expose the slag free surface of the molten metal 8 to the atmosphere within the hood 1, so that the flux composition 9 can be added from the hopper 4 to the molten metal 8. In order to increase the interaction between the molten metal 8 and the slag layer 10 formed from the added flux composition of the invention, stirring of the molten metal 8 may be set up by the upward bubbling of a non-oxidizing gas such as argon through a porous gas emission plug 6. After the end of dephosphorization, the hood 1 is taken off from the receptacle 7 to permit the mixing of slag layers 3 and 10, thereby the dephosphorizing slag 10 is oxidized by the slag 3 coming from the preceding stage to effect stabilization of the waste slag 10 while suppressing the occurrence of rephosphorization.

The dephosphorizing method of the invention results in production of the waste slag containing $CaC_2$ and $Ca_3P_2$ as the by-product. When this slag is allowed to stand in the air at ordenary temperatures, the calcium phosphide $Ca_3P_2$ reacts with water vapor in the air to produce phosphine $PH_3$, that is, $$Ca_3P_2(\text{in slag}) + 3H_2O(\text{in air}) \rightarrow 3CaO(\text{in slag}) + 2PH_3 \quad (10)$$

Figure 20:
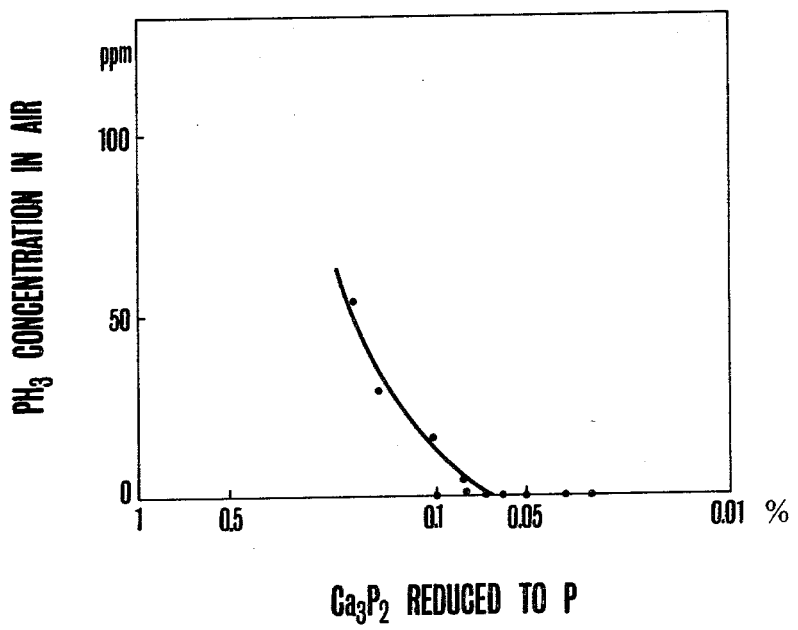
FIG. 20 is a graph showing variation of the concentration of phosphine produced in the air from the waste slag as a function of the concentration of phosphorus in the slag as the phosphorus is in the form of calcium phosphide.

Phosphine is a toxic gas, and therefore it is necessary to stabilize the waste slag against formation of phosphine. The amount of phosphine produced from the slag is dependent upon the concentration of calcium phosphide. It has now been found that when the percentage of phosphorus in the form of calcium phosphide is not more than 0.05% based on the total weight of the slag, formation of phosphine from the slag is negligible as shown in FIG. 20.

According to the present invention, it is possible to stabilize the slag by lowering the concentration of phosphorus in the form of calcium phosphide in the slag to 0.05% or less through the oxidizing treatment of the slag separated from the molten metal according to the formulae (11) and (12).

$$CaC_2 + 5O_2 \rightarrow 2CaO + 4CO_2 \quad (11)$$

$$Ca_3P_2 + 4O_2 \rightarrow 3CaO.P_2O_5 \quad (12)$$

Figure 19:
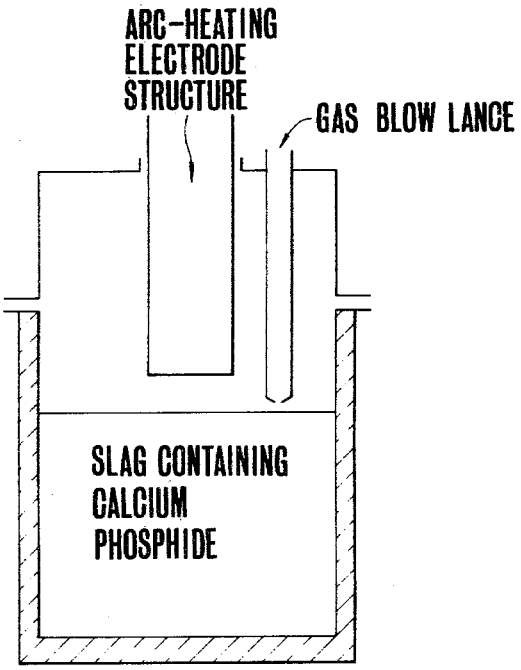
FIG. 19 is a schematic vertical sectional view of an example of the apparatus for oxidizing the waste slag by melting it under an oxidizing atmosphere.
Figure 21:
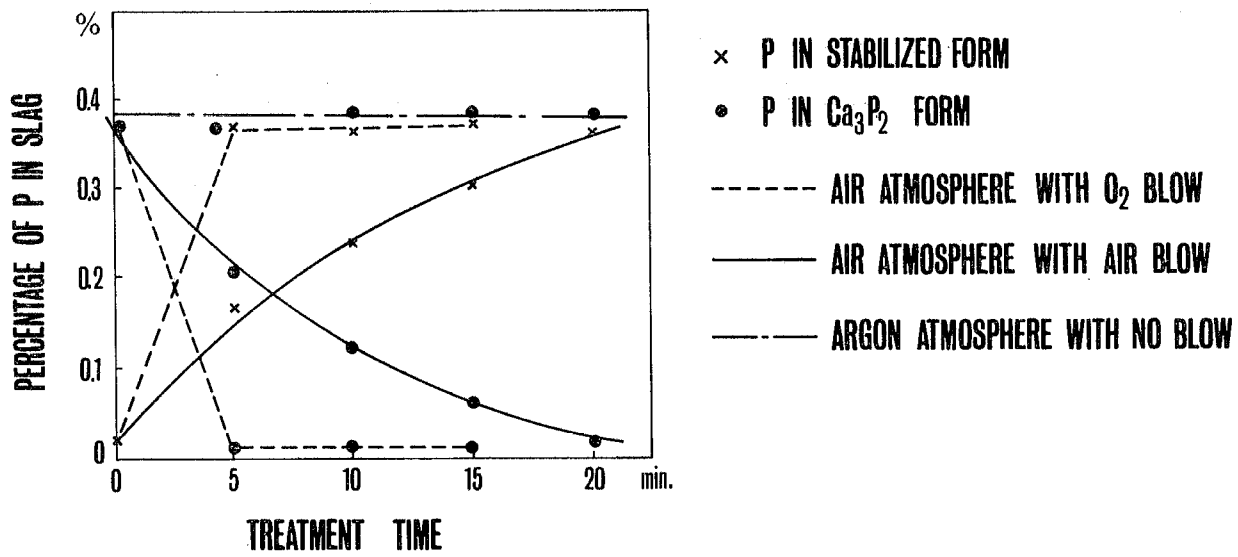
FIG. 21 is a graph showing variation with time of the concentration of phosphorus in the form of $Ca_3P_2$ in the waste slag as the oxidation of the slag proceeds in a controlled atmosphere.

An example of the apparatus for oxidizing the waste slag is shown in FIG. 19. The results of the oxidation treatment of the slag by use of the apparatus of FIG. 19 are shown in FIG. 21.

Figure 26:
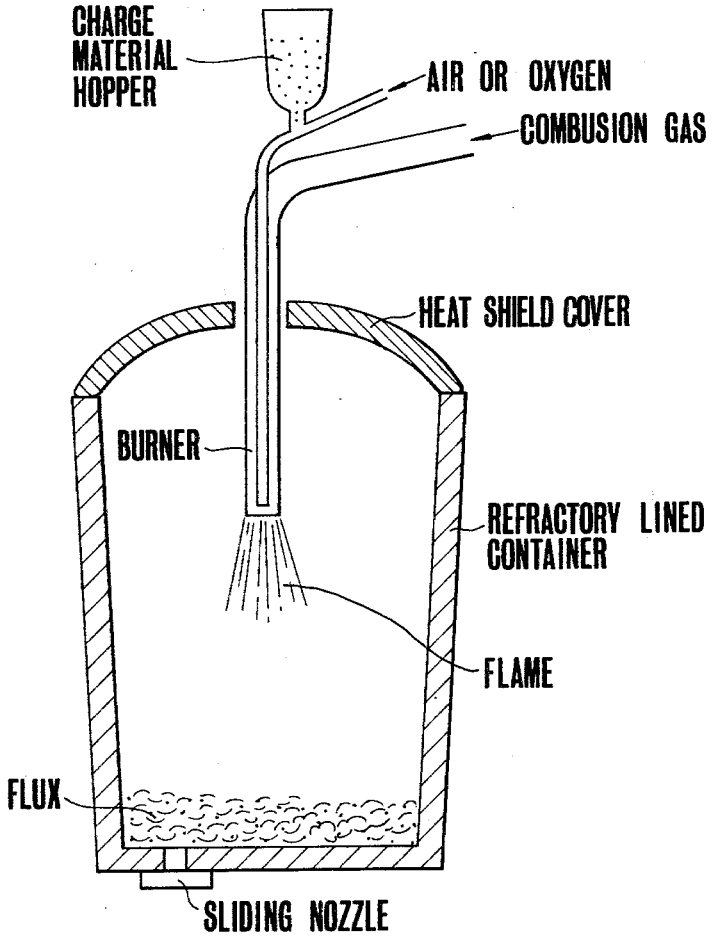
FIG. 26 is a vertical sectional view of an example of the burner adapted for use with a molten metal receptacle and capable of oxidizing the waste slag by the oxidizing flame.
Figure 27:
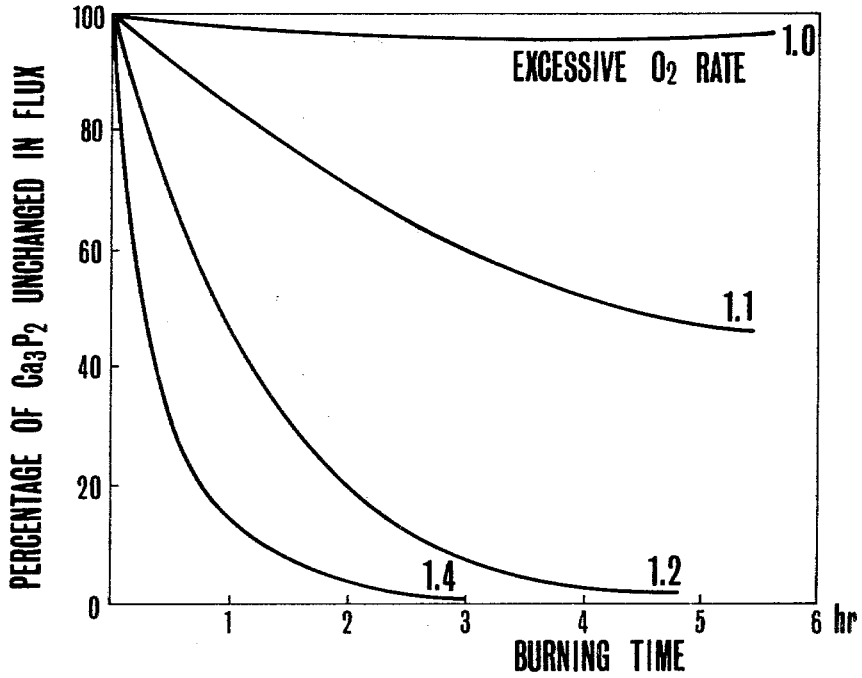
FIG. 27 is a graph showing the speed of conversion of $Ca_3P_2$ to a stabilized form as a function of the rate of excess oxygen gas supplied to the burner of FIG. 26, wherein the ordinate is in the percentage of phosphorus in the form of $Ca_3P_2$ left in the waste slag, and the abscissa is in the treatment time, with the parameter being the rate of excess oxygen relative to the theoretical amount of oxygen gas necessary to effect complete combusion as a unit.
Figure 28:
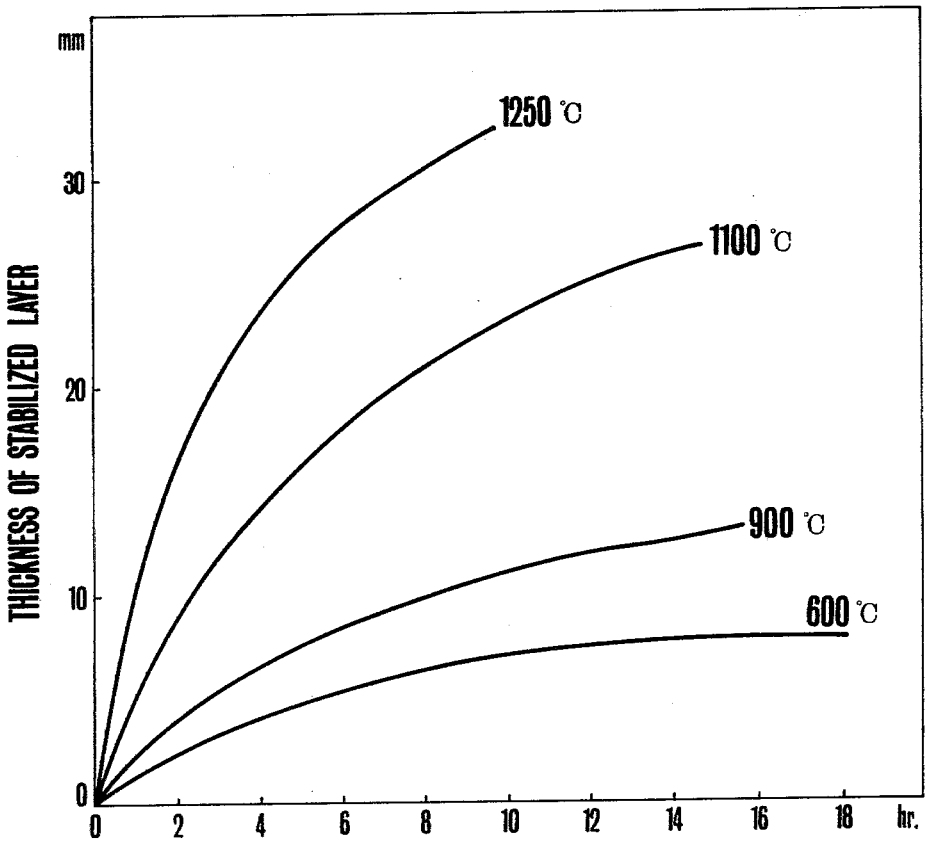
FIG. 28 is a graph showing the speed of formation of the stabilized layer of the slag block of FIG. 23 being exposed to an oxidizing atmosphere as a function of the treatment temperature ranging from 600° C. to 1250° C.

The slag separated from the molten metal is solidified at least partially. The waste slag prior to the oxidation treatment is brown but changes in color from brown through black finally to white at the surface portion thereof, during the oxidation treatment. The whitened portion results from the complete oxidation and contains phosphorus compounds all of which are stable to water. The necessary thickness of the completely oxidized layer of the slag body is preferably at least 0.1 mm, depending upon the final usage of the waste slag. For obtaining a completely oxidized layer of necessary thickness, it is enough to select the oxygen partial pressure in the atmosphere and the slag temperature patterns. It is preferred that the temperature of the isolated slag before the oxidation treatment is more than 200° C., or otherwise the slag reacts with the humidity of the air to produce phosphine. As shown in FIG. 26, the burner may be combined with the receptacle which holds the slag therein. After the receptacle is assembled with a cover (1), the burner (2) is operated with the supply of a combustion gas such as heavy oil gas, hydrocarbon gas, or CO type gas. As mentioned above, when the time interval between the termination of the dephosphorization and the initiation of the oxidation treatment is so long that the temperature of the slag is cooled down to less than 200° C., it is desirable to use the CO type gas to prevent formation of water vapor which would otherwise occur from the combusion of the gas. Air for combusion may be any one of the air itself, oxygen gas rich air and pure oxygen gas. By the burner heating, the temperature of the slag must be increased to and maintained at more than 600° C. This is because the thickness of the stabilized portion of the slag in the vicinity of the surface thereof is a function of the temperature. When the temperature is lower than 600° C., a slag piece having a diameter of 10 mm, for example, takes several tens of hours. As the oxygen source for the reactions of formulae (11) and (12), the combusion oxygen for the burner is preferably supplied in excess, in other words, the use of the oxidizing flame is more suited. Heat and oxygen may be separately applied to the slag, but their combination which leads to the oxidizing flame is rather advantageous from the standpoint of the energy efficiency and the reaction rate. FIG. 27 shows that the speed of conversion of calcium phosphide to the double salt of calcium oxide and phosphorus oxide is largely dependent upon the excess rate of oxygen supplied to the burner (the theoretically necessary amount of oxygen for complete combusion is taken as a unit, i.e., 1.0). It will be understood from FIG. 27 that the full stabilization of the waste slag can be achieved when the excess rate of oxygen is larger than 1.1, and preferably larger than 1.2.

Figure 29:
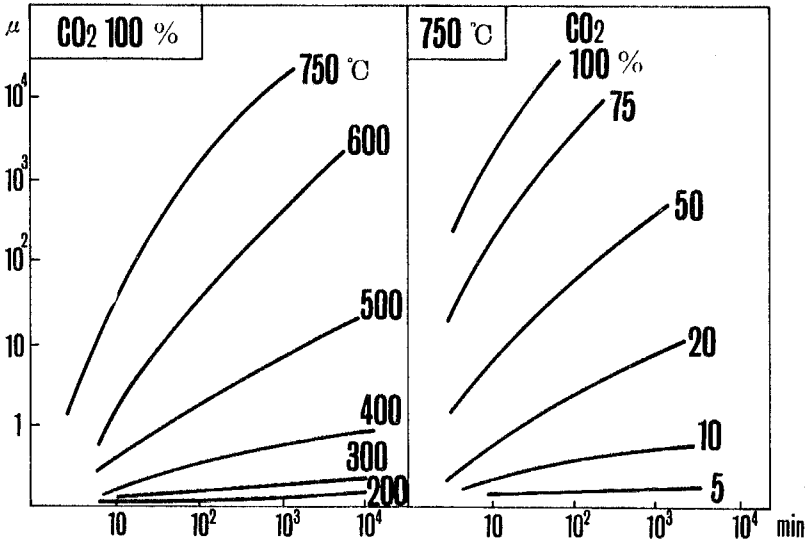
FIG. 29 is a graphs showing variation of the forming speed of a $CaCO_3$ coating on a waste slag block when exposed to a $CO_2$ atmosphere after the oxidation treatment as a function of the exposure time and $CO_2$ gas concentration respectively.

Subsequent, the slag is allowed to stand at a temperature of less than 800° C. in an atmosphere containing at least 10% of $CO_2$, whereby the calcium oxide in the slag reacts with $CO_2$ in the atmosphere to form $CaCO_3$ coating around the slag. This coating is stable to water and prevents the slag body from being collapsed by aeration. The higher the treatment temperature and also the higher the concentration of $CO_2$ in the atmosphere, the carbonization proceeds at a faster speed. At a temperature higher than about 800° C., however, the carbonate tends to decompose. The upper limit of a range of treatment temperatures is therefore 800° C. On the other-hand, as shown in FIG. 29, the rate of carbonatization is very small when the temperature is lower than 300° C., or when the concentration of $CO_2$ in the atmosphere is smaller than 10%.

The necessary thickness of the $CaCO_3$ coating must be determined by taking into account the final usage of the waste slag. When the after-treated waste slag is to be used, for example, as a subsidiary material for the charge of a steel making furnace, after it is stored in a dried state for a time period of 10 to 100 hours, the necessary thickness of the $CaCO_3$ coating is in a range of from a few microns to several tens of microns or more. If the after-treated waste slag is to be stored in a place susceptible to water, the $CaCO_3$ coating has to be increased in thickness to more than a few millimeters either by increasing the concentration of $CO_2$ in the atmosphere, or by increasing the retention time of the slag in the $CO_2$ atmosphere, or by the combination thereof. For example, a combusion gas containing a high percentage of CO may be employed to facilitate the heating and carbonatization. It is further desired that the waste slag before solidified into a few large blocks is divided into a great number of parts of small size to shorten the time necessary to practice the invention and also to improve the stability of the after-treated slag against the formation of phosphine. Further, when the slag is retained in the $CO_2$ atmosphere until cooled down to about 300° C., a dense and crack-free coating is formed to improve the stability of the after-treated slag.

According to the present invention, the waste slag which has been separated or further has been stabilized, may be further treated by reaction with another molten metal or alloy as has been described before, so that the calcium phosphide present in the slag is rephosphorized into the molten metal, and the slag is wholly stabilized. Unlike the dephosphorization treatment, this treatment must be carried out in an oxidizing atmosphere. The molten metal or alloy usuable in this step is either one which may be increased in phosphorus content, or one which after increased in phosphorus content is subjected to a subsequent refining treatment in which dephosphorization takes place as one of reactions to lower the phosphorus content to a permissible level. As an example of the former mention may be made of a high chrome molten metal for stainless steel making. As an example of the latter, mention may be made of low chrome molten metal with a chromium content lower than 4%, for example, molten pig iron and molten carbon steels. When the chromium content is less than 4%, the rephosporized molten metal may be refined by oxidation with suitably selected slag and oxygen supply method to decrease the phosphorus content to a permissible level, while suppressing the adverse effect due to the oxidation of chromium. As a result, one molten metal or alloy which can not be dephosphorized by conventional oxidizing refining is dephosphorized by use of the flux composition of the invention, while the phosphorus taken off from the molten metal is finally to be transferred to the oxidizing slag in which the phosphorus is retained in the stabilized form. Another molten metal which is contaminated when used to stabilize the slag can be easily refined by the conventional oxidizing method.

Two practical examples of application of the method of treating the slag is as follows: (1) After a first molten metal is discharged from a receptacle to leave the slag behind, a second molten metal is poured into the receptacle, while being mixed with the slag. In this case, the melting point of the slag may be lowered by addition of silica or iron oxide thereto, thereby the oxidation of the slag is facilitated. When the chromium content of the second molten metal is relatively low, the oxidizing refining may be further carried out by means such as of oxygen blowing to take off from the second molten metal all of or a part of the phosphorus which has once entered into the second molten metal. The thus treated slag is stable to water as high as that of the usual converter slag and therefore may be used for the same purpose.

(2) The slag isolated from the dephosphorized molten metal is charged into a converter or an electric furnace as a part of the subsidiary charge material, and then melted under an oxidizing atmosphere. In the case of the converter, all of the $CaC_2$, $Ca_3P_2$ and metallic Ca in the slag are converted to CaO and $P_2O_5$ which are retained in the oxidizing slag. Such results are identical to those effected by the conventional oxidizing refining. In the case of the electric furnace, the slag may be added during the melting-down and oxidizing stages as a slag-forming agent.

The present invention will now be further illustrated in and by the following examples. All percentages are by weight unless otherwise specified.

EXAMPLE 1

Twelve flux compositions are formulated in accordance with the invention using powdery $CaF_2$ of 99% purity, granular $CaC_2$ of 80% purity and granular $CaCl_2$ of 95% purity, the balance being powdery CaO of 98% purity, as shown in Table 1. In an induction furnace, 100 kg of a metal specimen selected from twelve specimens of iron and ferroalloys shown in Table 1 was heated to 1600°±10° C. in an argon atmosphere at 1 atm. and 5 kg of a respective flux composition was added to the molten metal. The results are shown in Table 1. During this operation, all the alloying elements are retained in yields of more than 98%.

Table 1

| Sample | | Flux Composition | | | | Variation of concentration of impurities | | | | | | | | | |
|---|---|---|---|---|---|---|---|---|---|---|---|---|---|---|---|
| | | | | | | Before dephosphorization | | | | | After dephosphorization | | | | |
| No. | Metal | $CaC_2$ | $CaF_2$ | $CaCl_2$ | CaO | P | S | N | O | C | P | S | N | O | C |
| 1 | Iron | 2 | 97 | — | 0.5 | 0.040 | 0.030 | — | 0.015 | 0.01 | 0.038 | 0.010 | — | 0.005 | 0.04 |
| 2 | " | 4 | 95 | — | 1 | 0.041 | 0.030 | — | 0.018 | 0.01 | 0.025 | 0.003 | — | 0.004 | 0.06 |
| 3 | " | 8 | 90 | — | 2 | 0.040 | 0.032 | — | — | 0.01 | 0.010 | 0.003 | — | — | 0.11 |
| 4 | " | 16 | 80 | — | 4 | 0.041 | 0.030 | 0.005 | — | 0.01 | 0.004 | 0.003 | 0.002 | — | 0.20 |
| 5 | " | 32 | 60 | — | 8 | 0.042 | 0.029 | 0.006 | 0.015 | 0.01 | 0.001 | 0.003 | 0.001 | 0.004 | 0.55 |
| 6 | 2C—Fe | 16 | 70 | 10 | 4 | 0.093 | 0.030 | 0.006 | — | 2.11 | 0.048 | 0.003 | 0.004 | — | 2.31 |
| 7 | 4C—Fe | 16 | 70 | 10 | 4 | 0.101 | 0.031 | 0.007 | — | 4.07 | 0.094 | 0.003 | 0.007 | — | 4.20 |
| 8 | SUS304 | 16 | 75 | 5 | 4 | 0.040 | 0.010 | 0.025 | | 0.95 | 0.005 | 0.003 | 0.011 | | 1.30 |
| 9 | 3C-3Si-63Cr—Fe | 16 | 75 | 5 | 4 | 0.035 | 0.026 | 0.050 | | 2.80 | 0.003 | 0.003 | 0.040 | | 3.0 |
| 10 | 2C-2Si-42Cr-30Ni—Fe | 16 | 75 | 5 | 4 | 0.035 | 0.025 | | | 2.05 | 0.003 | 0.003 | | | 2.21 |
| 11 | 5C-2.5Si-61Mo—Fe | 20 | 65 | — | 15 | 0.081 | 0.16 | | | 4.7 | 0.010 | 0.006 | | | 5.0 |

Table 1-continued

| Sample No. | Metal | Flux Composition $CaC_2$ | $CaF_2$ | $CaCl_2$ | CaO | Variation of concentration of impurities: Before dephosphorization P | S | N | O | C | After dephosphorization P | S | N | O | C |
|---|---|---|---|---|---|---|---|---|---|---|---|---|---|---|---|
| 12 | 0.01C-30Cr-1Mo—Fe | 16 | 75 | 5 | 4 | 0.020 | 0.010 | | | 0.01 | 0.002 | 0.003 | | | 0.22 |

(% by weight) The yield of the main alloy components was 98% or more.

EXAMPLE 2

A flux composition of the invention was made containing 85% $CaF_2$ and 15% $CaC_2$. Four ferrochromium specimens each in the form of an electrode having a diameter of 50 mm were remelted by arc in respective water-cool type steel molds having a diameter of 110 mm together with the flux composition in an initial amount of 500 grams with continuous addition of an additional total amount of 300 grams during the remelting operation, while applying to the electrode an AC or DC (electrode as negative) voltage of 25 to 27 volts with a current of 1500 amperes in an Ar atmosphere at 200 mmHg. The obtained ingots with a current of 15000 to 18000 amperes and, for the control, of 5000 amperes, in an Ar atmosphere of 1 atm., whereby about 500 kg of respective ingots were obtained. Each of the dephosphorized ingots was analyzed at three different regions, namely, to (T), middle (M) and bottom (B) regions, and the results are shown in Table 3.

Table 3

| 18Cr—Fe Flux | | Analysis | | C | P | S | O | N |
|---|---|---|---|---|---|---|---|---|
| 1 | First | Before | | 0.10 | 0.023 | 0.020 | 0.0105 | 0.0310 |
| | | After | B | 0.24 | 0.003 | <0.003 | 0.0050 | 0.0205 |
| | | | M | 0.18 | 0.014 | 0.004 | 0.0058 | 0.0310 |
| | | | T | 0.10 | 0.026 | 0.005 | 0.0041 | 0.0312 |
| 2 | Second | Before | | 0.10 | 0.023 | 0.020 | 0.0105 | 0.0310 |
| | | After | B | 0.68 | 0.002 | <0.003 | 0.0020 | 0.0127 |
| | | | M | 0.41 | 0.005 | 0.003 | 0.0020 | 0.0120 |
| | | | T | 0.18 | 0.010 | 0.003 | 0.0028 | 0.0183 |
| 3 | Third | Before | | 0.10 | 0.023 | 0.020 | 0.0105 | 0.0310 |
| | | After | B | 0.71 | 0.002 | <0.003 | 0.0018 | 0.0131 |
| | | | M | 0.52 | 0.005 | <0.003 | 0.0025 | 0.0122 |
| | | | T | 0.19 | 0.009 | <0.003 | 0.0020 | 0.0120 |
| 4 | Control | Before | | 0.10 | 0.023 | 0.020 | 0.0110 | 0.0305 |
| | | After | | 0.10 | 0.023 | 0.003 | 0.0070 | 0.0320 |

(% by weight)
"Before": Analysis of ESR electrode before treatment
"After": Analysis of cast after ESR melting Table 2

| Sample No. | Ferrochromium | Dephosphorization | Voltage | C | Cr | P | S | O | N |
|---|---|---|---|---|---|---|---|---|---|
| 1 | Medium Carbon | Before | A.C. | 3.10 | 65.1 | 0.026 | 0.016 | 0.012 | 0.0590 |
| | | After | | 3.41 | 65.1 | 0.005 | <0.003 | 0.009 | 0.0560 |
| 2 | Medium Carbon | Before | D.C. | 3.10 | 65.1 | 0.026 | 0.016 | 0.012 | 0.0530 |
| | | After | | 3.43 | 65.2 | 0.006 | <0.003 | 0.010 | 0.0560 |
| 3 | 18Cr Steel | Before | A.C. | 0.09 | 18.1 | 0.020 | 0.007 | 0.006 | 0.0263 |
| | | After | | 0.41 | 18.3 | 0.004 | <0.003 | 0.002 | 0.0152 |
| 4 | 18Cr Steel | Before | D.C. | 0.09 | 18.1 | 0.020 | 0.007 | 0.006 | 0.0263 |
| | | After | | 0.41 | 18.0 | 0.004 | <0.003 | 0.002 | 0.0160 |

(% by weight)

EXAMPLE 3

Three flux compositions of the invention were made with the first containing 5% $CaC_2$ and 95% $CaF_2$, with the second containing 10% $CaC_2$ and 90% $CaF_2$, and with the third containing 15% $CaC_2$ and 85% $CaF_2$, and a comparative flux composition outside the scope of the invention was made as a control containing 15% $Al_2O_3$, 20% CaO and 65% $CaF_2$. Four 18Cr-Fe specimens each in the form of an electrode having a diameter of 160 mm were electroslag-melted in respective water-cool type steel molds having a diameter of 210 mm together with the respective flux compositions each in an initial amount of 15 kg without subsequent continuous addition thereof, while applying to each of the respective electrodes an AC voltage of 30 to 35 volts

EXAMPLE 4

Two flux compositions of the invention were made with the first one for the initial addition containing 95% $CaF_2$ and 5% $CaC_2$ and with the second one for the subsequent continuous addition containing 80% $CaF_2$, 15% $CaC_2$ and 5% CaO. Seven ferroalloy specimens each in the form of an electrode having a diameter of 160 mm were electroslag remelted in respective water-cool type steel molds having a diameter of 210 mm together with the first flux composition each in an initial amount of 12 kg with subsequent continuous addition of the second flux composition each in an additional amount of 15 kg during the remelting operation, while applying to each of the respective electrodes a voltage of 30 to 35 volts with a current of 15000 to 18000 amperes in an Ar atmosphere at 1 atm., whereby 500 kg of respective ingots were obtained. Each of the obtained ingots was analyzed at a central portion along the longitudinal length, and the results are shown in Table 4. It has also been found that the impurities are uniformly removed throughout the entire body of the ingot as shown in FIG. 1 for No. 1 specimen, i.e. 0.1%C-18Cr steel.

Table 4

| Specimen No. | | Analysis C | Cr | P | S | O | N | As | Sb |
|---|---|---|---|---|---|---|---|---|---|
| 1. | Before | 0.10 | 18.8 | 0.015 | 0.007 | 0.006 | 0.0330 | 0.005 | 0.02 |
| | After | 0.43 | 18.7 | 0.003 | <0.003 | 0.001 | 0.0110 | 0.002 | <0.001 |
| 2. | Before | 0.14 | 13.5 | 0.020 | 0.020 | 0.008 | 0.0230 | 0.006 | 0.003 |
| | After | 0.50 | 13.6 | 0.005 | <0.003 | <0.001 | 0.0050 | 0.002 | <0.001 |
| 3. | Before | 3.07 | 65.2 | 0.028 | 0.018 | 0.0108 | 0.0640 | 0.008 | 0.004 |
| | After | 3.35 | 65.5 | 0.006 | <0.003 | 0.0090 | 0.0540 | 0.004 | <0.001 |
| 4. | Before | 0.11 | | 0.021 | 0.022 | 0.007 | 0.0045 | 0.004 | 0.004 |
| | After | 0.40 | | 0.003 | <0.003 | 0.001 | 0.0015 | 0.002 | <0.001 |
| 5. | Before | 0.50 | | 0.018 | 0.020 | 0.007 | 0.0051 | 0.003 | |
| | After | 0.78 | | 0.004 | <0.003 | 0.001 | 0.0016 | <0.001 | |
| 6. | Before | 0.95 | | 0.015 | 0.031 | 0.006 | 0.0059 | | |
| | After | 1.10 | | 0.008 | 0.003 | 0.001 | 0.0011 | | |
| 7. | Before | 0.95 | 18.1 | 0.020 | 0.019 | 0.0093 | 0.0140 | 0.006 | |
| | After | 1.20 | 18.2 | 0.002 | <0.003 | 0.0021 | 0.0040 | 0.002 | |

(% by weight)

EXAMPLE 5

Two flux compositions of the invention were made with the first one for the initial addition containing 90%$CaF_2$ and 10%$CaC_2$ and with the second one for the subsequent continuous addition containing 65%$CaF_2$ and 35%$CaC_2$. Four specimens of ferromolybdenum for No. 1, high carbon ferrochromium for No. 2, 1% carbon steel for No. 3, and pig iron for No. 4 each in the form of an electrode having a diameter of 160 mm were electroslag-remelted in respective water-cool type steel molds having a diameter of 210 mm together with the first flux composition each in an initial amount of 12 kg with subsequent continuous addition of the second flux composition each in an additional amount of 14 kg during the remelting operation, while applying to each of the respective electrodes a voltage of 30 to 35 volts with a current of 15000 to 17000 amperes in an Ar atmosphere at 1 atm, whereby about 500 kg of respective ingots were obtained. The analysis results are shown in Table 5. It has been found that the impurities are uniformly removed throughout the entire body of the ingot.

Table 5

| Specimen No. | | Analysis C | Mo or Cr | P | S | O | N |
|---|---|---|---|---|---|---|---|
| | | | Mo | | | | |
| 1. | Bef. | 4.2 | 61.3 | 0.081 | 0.16 | | |
| | Aft. | 4.5 | 61.1 | 0.011 | 0.005 | | |
| | | | Cr | | | | |
| 2. | Bef. | 6.3 | 62.1 | 0.023 | 0.019 | | 0.033 |
| | Aft. | 6.6 | 62.0 | 0.009 | <0.003 | | 0.017 |
| 3. | Bef. | 1.10 | | 0.021 | 0.022 | 0.006 | 0.005 |
| | Aft. | 1.41 | | 0.003 | <0.003 | 0.001 | 0.001 |
| 4. | Bef. | 4.07 | | 0.101 | 0.033 | | |
| | Aft. | 4.01 | | 0.099 | 0.003 | | |

(% by weight)

EXAMPLE 6

Figure 3:
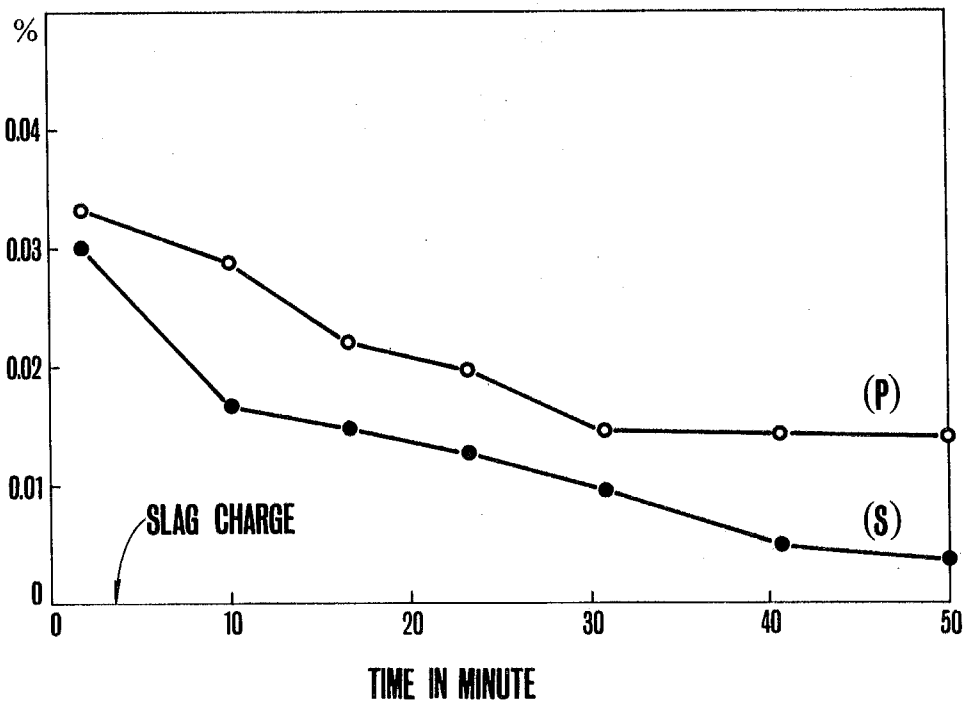
FIG. 3 is a graph showing variation with time of the concentrations of phosphorus and sulfur in a high carbon ferrochromium with 7.5%C and 64.1%Cr as the refining proceeds.

A flux composition of the invention was made containing 1.0 kg of powdery $CaF_2$ (purity: more than 99%), 3.5 kg of $CaC_2$ (purity: more than 90%, the remainder being almost CaO), and 0.5 kg of CaO (purity: 98%). The total amount (5 kg) of this flux composition was added through a flux charge chute 4 of FIG. 4 into 100 kg of a molten 7.5%C-64.1%Cr ferrochromium 2 heated to 1600° to 1610° C. in a refractory-lined container 3 of an induction melting furnace not shown, thereby a slag layer 1 was formed with a circular self-coating portion 8 in the vicinity of the inner periphery of the container 3, while maintaining an argon atmosphere over the slag layer 1 by introducing argon gas from a gas inlet 7 provided in a hood 4. Variation with time of concentration of phosphorus and sulfur in the molten ferrochromium 2 is shown in FIG. 3. During this dephosphorizing operation, the molten ferrochromium 2 was being stirred by argon gas bubbling from porous plug 5. In this example, the loss of the refractory lining 3 which is made from MgO by erosion is very small because of the presence of the self-coating portion 8.

EXAMPLE 7

Figure 4:
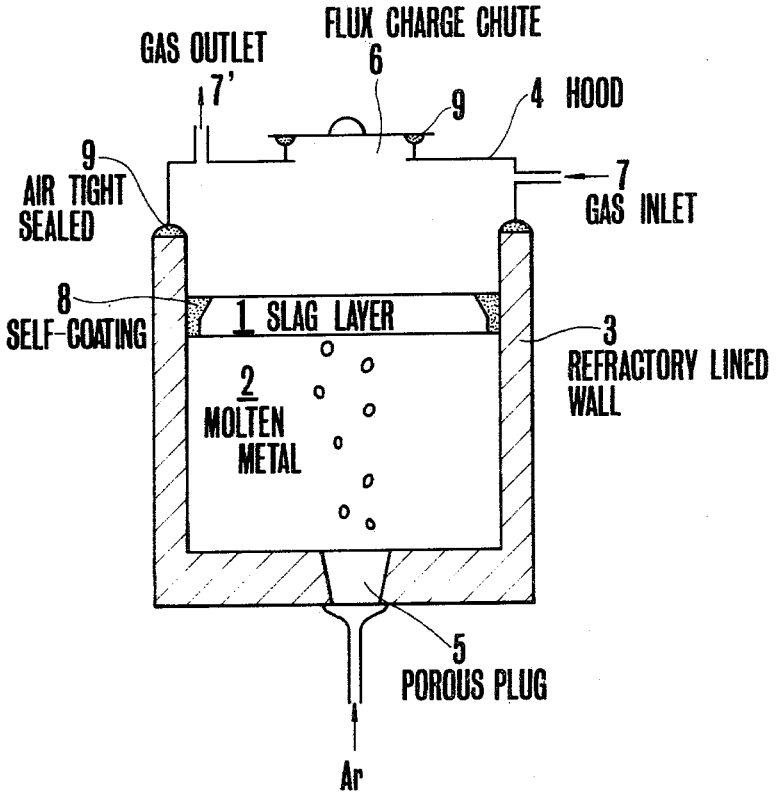
FIG. 4 is a vertical sectional view, partly schematic, of a molten metal receptacle provided with an auxiliary apparatus as an air-tight sealed unit under which the dephosphorization is performed.

Seven flux compositions of the invention were made from powdery $CaF_2$ of 99% purity, granular $CaC_2$ of 90% purity and granular CaO of 98% purity in proportions shown in Table 6. Seven ferroalloy specimens each in an amount of 100 kg were heated to 1600°±10° C. in respective dephosphorizing apparatus of the same construction as shown in FIG. 4 which were then charged with the respective flux compositions through the flux charge chutes 6, while maintaining an argon atmosphere at 1 atm. The dephosphorized ferroalloy specimens were analyzed, and the results are shown in Table 6, wherein the amount of refractory MgO attacked by the slag is measured in terms of percentage of MgO which is found in the slag layer 1 left behind when the molten metal is removed at the termination of duration of the dephosphorizing operation. It has been found that all the alloying elements are retained in yields of more than 98%.

Table 6

| Specimen No. | Ferroalloy | Flux composition $CaC_2$ | $CaF_2$ | CaO | Flux charge weight | Ar bubbling from porous plug | Concentration of Impurities: Before Treatment P | S | O | C | After Treatment P | S | O | C | Concentration of MgO in final slag |
|---|---|---|---|---|---|---|---|---|---|---|---|---|---|---|---|
| 1 | 4C-68Cr-3Si—Fe | 60 | 10 | 30 | 5 Kg | Run | 0.040 | 0.035 | — | 4.2 | 0.005 | 0.003 | — | 4.4 | 1.3 |
| 2 | 5C-61Mo-2.5Si—Fe | 60 | 10 | 30 | 5 | " | 0.082 | 0.030 | — | 5.1 | 0.010 | 0.003 | — | 5.5 | 1.6 |
| 3 | 4C—Fe | 70 | 10 | 20 | 5 | " | 0.100 | 0.031 | — | 4.0 | 0.080 | 0.003 | — | 4.3 | 1.1 |
| 4 | 3C-65Cr-1.5Si—Fe | 50 | 20 | 30 | 5 | " | 0.037 | 0.033 | — | 3.1 | 0.005 | 0.003 | — | 3.5 | 2.1 |
| 5 | 4C-68Cr-3Si—Fe | 60 | 10 | 30 | 2.5 | " | 0.030 | 0.031 | — | 3.8 | 0.014 | 0.003 | — | 4.1 | 1.4 |
| 6 | 8C-65Cr-1.5Si—Fe | 70 | 10 | 20 | 6 | " | 0.037 | 0.030 | — | 7.8 | 0.022 | 0.003 | — | 8.0 | 1.5 |
| 7 | 2C—Fe | 50 | 20 | 30 | 4 | None | 0.030 | 0.029 | — | 2.1 | 0.019 | 0.003 | — | 2.3 | 2.5 |

(% by weight)

The yield of the alloy components was 98% or more. "Final Slag" means the slag at the finish of the refinings.

EXAMPLE 8

Three sets of carbon-saturated ferroalloy speciments of 4C-Fe and 8.5C-61Cr-3.5Si-Fe each in an amount of about 100 Kg were melted in respective refining containers of induction melting furnaces which were then charged with respective flux compositions of the invention each in an amount of 5 Kg. The refining was made in an argon atmosphere. The flux compositions were made from granular $CaC_2$ (purity: 85%, the remainder being almost CaO), powdery $CaF_2$ (purity: 98%), granular metallic Ca (purity: 99.9%), granular CaO (purity: 98%) and granular CaSi (40%Ca-55%Si). The results are shown in Table 7, wherein the values in CaSi column are those obtained by reducing CaSi to Ca.

Table 7

| Specimen Set No. | Carbon-Saturated Ferroalloy | Flux Composition $CaC_2$ | Ca | CaSi | CaO | $CaF_2$ | Concentration of Impurities: Before Treatment P | S | After Treatment P | S |
|---|---|---|---|---|---|---|---|---|---|---|
| 1 | 4C—Fe | 75 | — | — | 15 | 10 | 0.095 | 0.032 | 0.094 | 0.008 |
| | 8.5C-61Cr-3.5 Si—Fe | 75 | — | — | 15 | 10 | 0.040 | 0.028 | 0.040 | 0.010 |
| 2. | 4C—Fe | 50 | 30 | — | 10 | 10 | 0.092 | 0.033 | 0.051 | 0.006 |
| | 8.5C-61Cr-3.5Si—Fe | 50 | 30 | — | 10 | 10 | 0.041 | 0.030 | 0.019 | 0.005 |
| 3. | 4C—Fe | 50 | — | 30 | 10 | 10 | 0.092 | 0.030 | 0.060 | 0.007 |
| | 8.5C-61Cr-3.5Si—Fe | 40 | — | 40 | 10 | 10 | 0.039 | 0.031 | 0.018 | 0.008 |

(% by weight)

CaSi represents Ca% in the complex flux admixed with CaSi alloy.

EXAMPLE 9

Three experiments (a), (b), and (c) each using three carbon-unsaturated alloys of 0.5%C-Fe for No. 1 specimen, 3%C-3%Si-63%Cr-Fe for No. 2 specimen and 0.5%C-18%Cr-8%Ni-Fe for No. 3 specimen were made to prove that the used of the invented flux composition as in Experiments (b) and (c) makes it possible to carry out dephosphorization and desulfurization without causing an increase of the carbon concentration in the molten alloy being treated, while the use of the flux composition outside the invention as in Experiment (a) results in an increase of the carbon concentration though the sulfur and phosphorus concentrations are decreased to considerable extents. All the flux compositions were made by using the same constituent-sourcing materials as those shown in Example 8. In these experiments, 100 Kg of the alloy specimen was melted in an induction furnace which was then charged with 5 kg of the flux composition. The refining was made in an argon atmosphere. The results are shown in Table 8, wherein the values in CaSi column are those obtained by converting CaSi to Ca.

Table 8

| Experiment No. | Specimen No. | Flux Composition $CaC_2$ | Ca | CaSi | CaO | $CaF_2$ | Concentration of Impurities and Carbon: Before Treatment P | S | C | After Treatment P | S | C |
|---|---|---|---|---|---|---|---|---|---|---|---|---|
| | No. 1 | 38 | — | — | 22 | 40 | 0.030 | 0.029 | 0.5 | 0.006 | 0.003 | 0.85 |
| a | No. 2 | 30 | — | — | 20 | 50 | 0.030 | 0.026 | 3.1 | 0.006 | 0.003 | 3.3 |
| | No. 3 | 27 | — | — | 23 | 50 | 0.031 | 0.030 | 0.5 | 0.006 | 0.003 | 1.03 |
| | No. 1 | 9 | 7 | — | 34 | 50 | 0.040 | 0.029 | 0.5 | 0.008 | 0.003 | 0.5 |
| b | No. 2 | 15 | 7 | — | 28 | 50 | 0.030 | 0.027 | 3.0 | 0.006 | 0.003 | 3.0 |
| | No. 3 | 3.5 | 7.5 | — | 39 | 50 | 0.030 | 0.030 | 0.5 | 0.006 | 0.003 | 0.5 |
| | No. 1 | 9 | — | 7.1 | 33.9 | 50 | 0.030 | 0.026 | 0.5 | 0.006 | 0.003 | 0.5 |
| c | No. 2 | 15 | — | 7 | 28 | 50 | 0.030 | 0.029 | 3.0 | 0.006 | 0.003 | 3.0 |

Table 8-continued

| Experiment No. | Specimen No. | Flux Composition $CaC_2$ | Ca | CaSi | CaO | $CaF_2$ | Concentration of Impurities and Carbon: Before Treatment P | S | C | After Treatment P | S | C |
|---|---|---|---|---|---|---|---|---|---|---|---|---|
| | No. 3 | 3.5 | — | 7.5 | 39 | 50 | 0.030 | 0.028 | 0.5 | 0.005 | 0.003 | 0.5 |

(% by weight)

EXAMPLE 10

To prove that the reliance on formula (6), i.e, $$A \geqq \sqrt{\frac{\alpha\eta}{1.5(100-\eta)}}\ (4z^2 + x)$$

leads to the expected result of dephosphorization, various flux compositions were made as adapted for use with respective alloy compositions, while controlling the concentration of $CaC_2$ in accordance with the calculated effective carbon concentration, so that dephosphorization is to be effected at a desired efficiency of 70% with a Ca conversion parameter of x=4. Seven carbon-unsaturated ferroalloy specimens listed in Table 9 each in an amount of 100 kg were melted in respective induction melting furnaces, which were then charged with respective flux compositions of the invention. All the flux compositions were prepared by using the same constituent-sourcing materials as those shown in Example 8. The dephosphorizing was carried out in an argon atmosphere at 1 atm. The results are shown in Table 9.

Table 9

| Felloalloy | Flux Composition $CaC_2$ | $CaF_2$ | CaO | Concentration of phosphorus: Before Treatment | Calculated Value | Found Value |
|---|---|---|---|---|---|---|
| 5.6C-63Cr—Fe | 51 | 36 | 13 | 0.041 | 0.0123 | 0.011 |
| 4.5C-61Mo—Fe | 36 | 37 | 27 | 0.050 | 0.015 | 0.014 |
| 0.6C—Fe | 47 | 35 | 18 | 0.080 | 0.024 | 0.024 |
| 0.6C-18Cr- | | | | | | |

Table 9-continued

| Felloalloy | Flux Composition $CaC_2$ | $CaF_2$ | CaO | Concentration of phosphorus: Before Treatment | Calculated Value | Found Value |
|---|---|---|---|---|---|---|
| 8Ni—Fe | 32 | 45 | 23 | 0.039 | 0.0117 | 0.018 |
| 0.5C-25Cr—Fe | 29 | 45 | 26 | 0.031 | 0.0093 | 0.0091 |
| 0.5C-25Cr-3Mo—Fe | 28 | 47 | 25 | 0.030 | 0.0090 | 0.0090 |
| 0.5C-8cr—Fe | 38 | 37 | 25 | 0.028 | 0.0084 | 0.0080 |

(% by weight)

EXAMPLE 11

Various experiments were made for examining dependence of the efficiency of phosphorization either on the $O_2$, $CO_2$ and $H_2O$ gas concentrations in an atmosphere or on the partial pressures of $O_2$, $CO_2$ and $H_2O$ gases in an atmosphere at a total atmospheric pressure of either 500 mmHg or 850 mmHg. In each of these experiments, 100 kg of a molten 7.0% C-63% Cr-Fe in a FIG. 4 refining container of an induction melting furnace was charged with 5 kg of a flux composition containing 3.5 kg of granular $CaC_2$ of 85% purity, 1 kg of powdery $CaF_2$ of 99% or more purity and 0.5 kg of powdery CaO of 98% or more purity. The results are shown in FIGS. 7 and 8 for the dependence of the relative efficiency of dephosphorization on the $O_2$, $CO_2$ and $H_2O$ gas concentrations in an Ar atmosphere, wherein the relative efficiency is the unit when the atmosphere is made from only pure Ar gas substantially free from oxidating gases. Representative data obtained in these experiments are summarized in Tables 10 and 11.

Table 10

Dependence of dephosphorization efficiency on atmospheric composition

| Experiment No. | Atmospheric Composition at 1 Atm. (Volume %) $O_2$ | $CO_2$ | $SO_2$ | $H_2O$ | Sum* | Balance | Concentration of Impurities (weight %): Before Treatment P | S | After Treatment P | S |
|---|---|---|---|---|---|---|---|---|---|---|
| 1 | 20.9 | 0.8 | <0.1 | 2.1 | 23.8 | Air | 0.035 | 0.030 | 0.035 | 0.010 |
| 2 | <0.1 | <0.1 | <0.1 | <0.1 | 1.0 | Argon | 0.035 | 0.030 | 0.012 | 0.005 |
| 3 | 2.2 | 2.0 | <0.1 | 1.0 | 5.3 | " | 0.034 | 0.030 | 0.015 | 0.005 |
| 4 | 2.1 | 2.1 | 1.1 | 1.0 | 6.3 | " | 0.035 | 0.031 | 0.016 | 0.006 |
| 5 | 5.1 | 3.6 | <0.1 | <0.1 | 8.7 | " | 0.034 | 0.030 | 0.030 | 0.008 |
| 6 | 5.3 | 2.2 | 1.0 | 3 | 10.5 | " | 0.035 | 0.030 | 0.031 | 0.008 |
| 7 | 3.1 | 2.0 | 1.0 | 0.8 | 6.9 | " | 0.035 | 0.031 | 0.024 | 0.006 |

*Sum = $O_2$ (%) + $CO_2$ (%) + $SO_2$ (%) + $H_2O$ (%)

Table 11

Dependence of dephosphorization efficiency on partial pressures of atmospheric component gases

| Experiment No. | Atmospheric Composition (mmHg) (Balance: Argon gas) $O_2$ | $CO_2$ | $SO_2$ | $H_2O$ | Sum* | Total Pressure | Concentration of Impurities %) Before Treatment P | S | After Treatment P | S |
|---|---|---|---|---|---|---|---|---|---|---|
| 8 | 100 | 0.6 | <1 | 10 | 111.6 | 500 | 0.035 | 0.031 | 0.035 | 0.008 |
| 9 | 17 | 10 | <1 | 10 | 37 | 500 | 0.035 | 0.031 | 0.018 | 0.006 |
| 10 | 40 | 20 | <1 | 20 | 80 | 850 | 0.036 | 0.030 | 0.033 | 0.008 |
| 11 | 35 | 20 | <1 | 1 | 56 | 850 | 0.032 | 0.033 | 0.020 | 0.005 |

*Sum = $O_2$ (mmHg) + $CO_2$ (mmHg) + $SO_2$ (mmHg) + $H_2O$ (mmHg)

EXAMPLE 12

Variation of the dephosphorizing efficiency in a molten metal with respect to $N_2$ partial pressure was measured in such a manner that whilst 100 kg of a crude stainless steel containing 17.5% Cr, 81.3% Fe, 1.1% C, 0.037% P, 0.034% S and 0.025% N was melted in an induction furnace together with a flux composition of the invention in an amount of 2 kg for data A, 1 kg for data B and 0.5 kg for data C, the $N_2$ partial pressure over the slag layer formed from the added flux composition on the surface of the molten crude stainless steel was varied either by using different mixtures of $Ar+N_2$ in different proportions, or by supply control of air as the atmosphere was retained by an air tight shield hood 4 having atmosphere control gas inlet 7 and outout 7' (see FIG. 4) through which one atmosphere was substituted by another. The flux composition was made containing 70% of calcium carbide and 30% of purified fluorite. Samples of the dephosphorized ferrochromium were taken in 10 minutes after the addition of the flux composition to the molten metal body. The actual values of the $N_2$ partial pressure were determined by gas chromatography. The results obtained in connection with the $Ar+N_2$ supply control and the air supply control are shown in FIGS. 12 and 13 respectively. Some of the obtained data A, B and C are summerized in Table 12.

Table 12

| Atmosphere control gas | Flux percentage | $N_2$ Partial Pressure (mmHg) | Concentration of Impurities in Molten crude Stainless Steel at 10 min's treatment P | S | N | Degree of Phosphorization |
|---|---|---|---|---|---|---|
| | | mmHg | | | | |
| | | 13 | 0.011 | 0.008 | 0.009 | 69 |
| | | 125 | 0.014 | 0.008 | 0.012 | 63 |
| | 2% | 260 | 0.017 | 0.009 | 0.018 | 53 |
| | | 350 | 0.020 | 0.008 | 0.026 | 45 |
| | | 420 | 0.030 | 0.008 | 0.035 | 18 |
| | | 600 | 0.035 | 0.009 | 0.048 | 5 |
| | | 70 | 0.018 | 0.015 | 0.018 | 50 |
| | | 165 | 0.020 | 0.016 | 0.021 | 47 |
| | 1% | 250 | 0.022 | 0.014 | 0.026 | 39 |

Table 12-continued

| Atmosphere control gas | Flux percentage | $N_2$ Partial Pressure (mmHg) | Concentration of Impurities in Molten crude Stainless Steel at 10 min's treatment P | S | N | Degree of Phosphorization |
|---|---|---|---|---|---|---|
| | | 350 | 0.027 | 0.015 | 0.034 | 28 |
| Ar | | 455 | 0.035 | 0.015 | 0.042 | 4 |
| | | 625 | 0.036 | 0.016 | 0.056 | <2 |
| + | | | | | | |
| | | 110 | 0.026 | 0.021 | 0.021 | 29 |
| | | 230 | 0.028 | 0.022 | 0.026 | 26 |
| $N_2$ | 0.5% | 390 | 0.034 | 0.020 | 0.038 | 7 |
| | | 480 | 0.036 | 0.020 | 0.046 | <2 |
| | | 560 | 0.037 | 0.020 | 0.052 | <2 |
| | | 25 | 0.013 | 0.011 | 0.012 | 64 |
| | 2% | 98 | 0.016 | 0.012 | 0.013 | 56 |
| | | 220 | 0.034 | 0.011 | 0.025 | 8 |
| | | 45 | 0.020 | 0.018 | 0.019 | 48 |
| Air | 1% | 125 | 0.030 | 0.017 | 0.025 | 19 |
| | | 260 | 0.037 | 0.018 | 0.031 | <2 |
| | 0.5% | 210 | 0.037 | 0.030 | 0.028 | <2 |

(% by weight)

EXAMPLE 13

A molten crude stainless steel of 18% Cr-8% Ni-1.1% C was prepared in an electric furnace of 30 t capacity and then three different amounts of aluminum were added to respective portions of the molten steel to make three specimens A, B and C of different oxygen content. Each of the specimens was poured through a pony ladle into a receptacle of which the interior space was filled with argon gas. The necessary time interval for the molten steel specimen to be transported from the pony ladle to the receptacle was about 5 minutes during which a mixture of 15 kg/t of calcium carbide and 4 kg/t of purified fluorite was continuously added to that portion of the molten steel which was received by the receptacle, thereby good mixing of the added flux and the molten steel was ensured by agitation by the molten steel stream. The results are shown in Table 13, wherein the data are obtained by analyzing the molten steel in the ladle and the dephosphorized molten steel.

Table 13

| Specimen No. | Molten Steel Composition In Pony Ladle C | P | S | Al | O | After Dephosphorization C | P | S | Al | O | Efficiency of Dephosphorization |
|---|---|---|---|---|---|---|---|---|---|---|---|
| | ppm | | | | | ppm | | | | | |
| A | 1.1 | 0.032 | 0.028 | <0.001 | 205 | 1.4 | 0.028 | 0.011 | <0.001 | 28 | 13 |
| B | 1.1 | 0.032 | 0.029 | 0.005 | 145 | 1.4 | 0.019 | 0.008 | 0.003 | 12 | 41 |

Table 13-continued

| Specimen No. | Molten Steel Composition: In Pony Ladle C | P | S | Al | O | After Dephosphorization C | P | S | Al | O | Efficiency of Dephosphorization |
|---|---|---|---|---|---|---|---|---|---|---|---|
| | ppm | | | | | ppm | | | | | |
| C | 1.1 | 0.031 | 0.028 | 0.025 | 35 | 1.4 | 0.015 | 0.007 | 0.015 | 30 | 52 |

(% by weight)

EXAMPLE 14

Three molten crude stainless steel specimens were prepared in such a manner as that shown in Example 13, and then charged into respective receptacles. While the unavoidably accompanied slag was being pushed to the side wall of the receptacle by an air tight sealed hood, a mixture of 12 kg/t of calcium carbide and 5 kg/t of purified fluorite was added in whole at a time into the respective specimen, and then the system was stirred by the upward bubbling of argon gas from a porous gas emission plug provided in the bottom wall of the receptacle for 10 minutes. The results are shown in Table 14.

Table 14

| Specimen No. | Molten Steel Composition Before and After Dephosphorization: Before Addition of Flux C | P | S | Al | O | After Treatment C | P | S | Al | O | Efficiency of Dephosphorization |
|---|---|---|---|---|---|---|---|---|---|---|---|
| | ppm | | | | | ppm | | | | | |
| A | 1.1 | 0.032 | 0.029 | <0.001 | 236 | 1.3 | 0.030 | 0.013 | <0.001 | 0.041 | 8 |
| B | 1.1 | 0.032 | 0.028 | 0.015 | 98 | 1.3 | 0.021 | 0.010 | 0.008 | 0.035 | 36 |
| C | 1.1 | 0.032 | 0.028 | 0.038 | 56 | 1.3 | 0.019 | 0.011 | 0.025 | 0.029 | 42 |

(% by weight)

EXAMPLE 15

An electric furnace was charged with usual steel scrap, stainless steel scrap, high carbon ferrochromium and ferronickel, and then the charge material was melted and subjected to primary decarburization to respective different levels by the oxygen blowing method to prepare two molten metal specimens A and B of different carbon content. Each of these specimens A and B was transferred from the furnace through a pony ladle 5 of FIG. 17 to a receptacle 4 while the respective flux composition was added from a hopper 6. On the other hand, a mixture of argon and propane in a proportion of 1:1 was supplied through an atmosphere control gas inlet 2 into the interior of the receptacle 4 and pure argon gas was supplied through a porous gas emission plug 3 to the molten metal 8 to agitate it by the argon gas bubbling. After the completion of dephosphorization, the sliding nozzle 1 was opened to tap the dephosphorized molten metal into another receptacle and then closed just before the slag exited therefrom, thus the molten metal 8 and the slag 7 being separated from each other. The dephosphorized molten metal was transferred to a vacuum vessel and then subjected to finishing decarburization by the oxygen blowing method. The results are shown in Table 15.

Table 15

| Specimen No. | Flux Composition and Molten Stainless Steel Composition at Various Points in a Steel Making Process: A | | | | | B | | | | |
|---|---|---|---|---|---|---|---|---|---|---|
| Flux Composition | $CaC_2$ | $CaF_2$ | CaO | MgO | $Al_2O_3$ | $CaC_2$ | $CaF_2$ | CaO | MgO | $Al_2O_3$ |
| | 51 | 30 | 14 | 2 | 3 | 45 | 40 | 12 | 1 | 2 |
| Amount of Flux Used | 5 kg/t | | | | | 10 kg/t | | | | |
| Element | C | Cr | Ni | P | S | C | Cr | Ni | P | S |
| Molten Steel Composition: After Primary Decarburization | 1.41 | 18.3 | 8.0 | 0.030 | 0.018 | 0.61 | 18.0 | 7.9 | 0.028 | 0.019 |
| After Dephosphorization | 1.45 | 18.3 | 8.1 | 0.019 | 0.006 | 0.69 | 18.0 | 8.0 | 0.013 | 0.007 |
| After Finishing Decarburization | 0.05 | 18.0 | 8.0 | 0.018 | 0.005 | 0.05 | 17.6 | 8.0 | 0.014 | 0.006 |

(% by weight)

EXAMPLE 16

Using a converter, a molten pig iron was decarburized and dephosphorized, then high carbon ferrochromium was added, and then the molten charge mixture was decarburized again. The subsequent procedure was almost the same as in Example 15. The results are shown in Table 16 and Table 17.

Table 16

| Flux Composition and Molten Steel Composition at Various Points in a Steel Making Process | | | | |
|---|---|---|---|---|
| Flux Composition | $CaC_2$ | $CaF_2$ | CaO | Al |
| | 50 | 35 | 11 | 4 |
| Amount of Flux Used | 5 kg/t | | | |
| Element | C | Cr | P | S |
| Molten Steel Composition: After Primary Decarburization | 0.43 | 16.9 | 0.032 | 0.018 |
| After Dephosphorization | 0.51 | 17.0 | 0.023 | 0.008 |
| After Finishing Decarburization | 0.05 | 16.7 | 0.021 | 0.007 |

(% by weight)

Table 17

| | | Molten Steel Composition | | | | | | | Flux Composition | | | Amount of Flux used |
|---|---|---|---|---|---|---|---|---|---|---|---|---|
| | | C | Si | Mn | P | S | Ni | Cr | $CaC_2$ | $CaF_2$ | CaO | kg/t |
| A | 1 As tapped | 1.41 | 0.36 | 0.50 | 0.030 | 0.024 | 9.1 | 18.3 | 56 | 30 | 14 | 5 |
| | 1 After Dephosphorization | 1.46 | 0.36 | 0.52 | 0.020 | 0.010 | 9.0 | 18.3 | | | | |
| | 2 As tapped | 1.21 | 0.09 | 0.37 | 0.024 | 0.020 | 10.1 | 18.5 | 48 | 40 | 12 | 10 |
| | 2 After Dephosphorization | 1.32 | 0.10 | 0.39 | 0.011 | 0.006 | 10.1 | 18.6 | | | | |
| B | 1 As tapped | 0.43 | 0.02 | 0.31 | 0.032 | 0.024 | — | 16.0 | 56 | 30 | 14 | 5 |
| | 1 After Dephosphorization | 0.51 | 0.03 | 0.33 | 0.013 | 0.011 | — | 16.1 | | | | |
| | 2 As tapped | 0.25 | 0.01 | 0.35 | 0.029 | 0.027 | — | 17.4 | 48 | 40 | 12 | 10 |
| | 2 After Dephosphorization | 0.39 | 0.04 | 0.39 | 0.008 | 0.006 | — | 17.4 | | | | |

(% by weight)

EXAMPLE 17

A shaft type reduction furnace was charged with chrome-iron ore, iron ore, coke and $CaCO_3$ and an oxygen rich air ($O_2$: 42%) was blown into the charge material to make a molten high chrome pig iron with the resultant composition being shown in Sample No. 1 line. Next, the molten metal was desiliconized by oxygen blowing, and then a ferronickel after melted by an electric furnace was added. The resultant steel composition is shown in Sample No. 2 line. After the produced slag was removed, the molten metal was sealed by argon gas, then a flux composition containing 10 kg/t of calcium carbide and 3 kg/t of a purified fluorite was added to the molten steel, and then the bubbling was carried out by use of argon gas (Sample No. 3). After the molten metal is separated from the slag, the molten metal was subjected to primary decarburization and then to finishing decarburization under vacuum by oxygen blowing (Sample No. 4).

Table 18

| Sample No. | Variation of molten Steel Composition as the Process Proceeds | | | | | | |
|---|---|---|---|---|---|---|---|
| | Cr | Fe | Ni | C | Si | P | S |
| 1 | 25 | 67 | — | 4.6 | 3.2 | 0.69 | 0.045 |
| 2 | 18 | 69 | 8 | 3.5 | 0.5 | 0.52 | 0.039 |
| 3 | 18 | 69 | 8 | 3.9 | 0.5 | 0.031 | 0.009 |
| 4 | 18 | 69 | 8 | 0.05 | 0.2 | 0.033 | 0.010 |

(% by weight)

EXAMPLE 18

A desiliconized molten high chrome steel was made in such a manner as that shown in Example 17. Next, the slag was removed, then the molten steel was protected by argon gas, and then a mixture of 6 kg/t of calcium carbide, 3 kg/t of a purified fluorite and 3 kg/t of calcium silicide (25% Ca) was added to the molten steel. The dephosphorization was carried out with the bubbling of argon gas. The resultant composition of the dephosphorized molten steel is shown in Table 19.

Table 19

| Cr | Fe | Ni | C | Si | P | S |
|---|---|---|---|---|---|---|
| 18 | 69 | 8 | 3.7 | 0.6 | 0.029 | 0.008 |

(% by weight)

As is understandable from Examples 17 and 18, the dephosphorizing method of the invention is advantageously applicable to a process for making high chrome steel through high chrome pig iron economically which process is characterized by its difficulty of performing dephosphorization. This effectiveness of the invention does not diminish when the high chrome pig iron is prepared by an electric furnace.

EXAMPLE 19

A molten crude 18% Cr-8% Ni stainless steel (Sample No. 1) was made by an electric furnace and then transferred therefrom to a ladle. After the oxygen content was adjusted by addition of aluminum, the molten steel was tapped through a nozzle provided in the bottom wall of the ladle to an A.O.D. furnace, while the oxidizing slag migrated from the electric furnace being left in the ladle. The A.O.D. furnace in the normal position was supplied with argon gas through an agitation gas inlet to stir the molten steel (Sample No. 2), and then a mixture of 12 kg/t of calcium carbide of 80% purity and 4 kg/t of a purified fluorite was added to the molten steel. After 10 minutes' stirring, the furnace with the molten metal (Sample No. 3) is tilted to a point at which the inside end of the gas inlet was at a hight of 10 cm above the slag layer, and then pure oxygen gas was introduced through the gas inlet onto the slag layer for 10 minutes. Next, the furnace with the molten steel (Sample No. 4) is further tilted to a point where the slag was removed. The furnace was returned to the normal position where finishing decarburization was performed to obtain a final product (Sample No. 5).

Table 20

| Sample No. | Variation of Steel Composition as Process Proceeds | | | | |
|---|---|---|---|---|---|
| | Composition | | | | |
| | C | Cr | P | S | O |
| 1 | 1.2 | 18.0 | 0.028 | 0.034 | 0.025 |
| 2 | 1.2 | 18.1 | 0.028 | 0.034 | 0.008 |
| 3 | 1.4 | 18.0 | 0.013 | 0.009 | 0.003 |
| 4 | 1.4 | 18.0 | 0.015 | 0.009 | 0.004 |

Table 20-continued

| Sample No. | Variation of Steel Composition as Process Proceeds — Composition C | Cr | P | S | O |
|---|---|---|---|---|---|
| 5 | 0.05 | 18.0 | 0.015 | 0.005 | 0.003 |

EXAMPLE 20

A molten 18%Cr-8%Ni stainless steel was made in such a manner as that shown in Example 19 except that a mixture of argon and oil mist was used as the gas for agitation when the dephosphorization was carried out, and the slag layer was oxidized by blowing oxygen gas not to the above of it but into the interior thereof. The results are shown in Table 21.

Table 21

| Sample No. | C | Cr | P | S | O |
|---|---|---|---|---|---|
| 1 | 1.3 | 17.8 | 0.025 | 0.018 | 0.019 |
| 2 | 1.3 | 17.7 | 0.025 | 0.018 | 0.007 |
| 3 | 1.5 | 17.9 | 0.010 | 0.007 | 0.004 |
| 4 | 1.5 | 17.8 | 0.013 | 0.008 | 0.005 |
| 5 | 0.06 | 17.7 | 0.013 | 0.005 | 0.003 |

(% by weight)

In both Examples 19 and 20, the waste slag taken out of A.O.D. furnace was stored in a slag receptacle for two days, and then utilized as part of the slag-forming agent for an electric furnace. It was found that the waste slag did not produce bad oder attributable to phosphine.

EXAMPLE 21

In an electric furnace for steel making, the melting and oxidizing refining operation was performed to produce a molten steel (Sample No. 1). The molten steel was transferred from the furnace to a receptacle of the type shown in FIG. 18, and at the same time about 4 kg/t of slag accompanied. Next, the hood with a slag breaker was brought into the metals in the receptacle, and then a mixture of 15 kg/t of calcium carbide and 7 kg/t of a purified fluorite was added from the flux supplying apparatus attached to the hood to the molten metal with stirring by the upward bubbling of argon gas through the porous plug. After 10 minutes' treatment, the hood was taken off from the dephosphorized molten metal (Sample No. 2), whereby the slags of the first and second steps were mixed to oxidize the second-step slag for two minutes with stirring and for further five minutes with no stirring. The final molten steel thus obtained had a composition shown by Sample No. 3 in Table 22. When this final slag of which the average composition is shown in Table 23 was allowed to stand in the air, no phosphine could be detected from the slag environment. This slag was usuable as part of a slag forming agent in melting operation stage.

Table 22

| Sample No. | Composition of Molten Steel C | Cr | Ni | P | S |
|---|---|---|---|---|---|
| 1 | 1.10 | 18 | 8 | 0.030 | 0.035 |
| 2 | 1.25 | 18 | 8 | 0.014 | 0.009 |
| 3 | 1.23 | 18 | 8 | 0.016 | 0.008 |

(% by weight)

Table 23

| Composition of Slag CaO | $CaF_2$ | $CaC_2$ | MgO | $Cr_2O_3$ | $Ca_3P_2$ | Total P |
|---|---|---|---|---|---|---|
| 63 | 24 | <0.5 | 3.5 | 2.3 | <0.01 | 0.5 |

(% by weight)

EXAMPLE 22

Using a converter type receptacle, a molten high carbon ferrochromium was decarburized by the oxygen blowing method to produce a medium carbon ferrochromium (Sample No. 1). Next, the receptacle was transported into a low frequency induction furnace and assembled with a flux applying apparatus of FIG. 18 to apply a flux composition containing 13 kg/t of calcium carbide and 8 kg/t of a purified fluorite onto the oxidizing slag free surface portion of the molten ferrochromium body with stirring by the bubbling of argon gas. After 20 minutes' dephosphorizing operation, the flux applying apparatus was taken off from the receptacle holding the dephosphorized molten ferrochromium (Sample No. 2), whereby the oxidizing slag resulted from the decarburization treatment and the slag resulted from the dephosphorization treatment were mixed to oxidize the latter. Thereafter, the molten ferrochromium (Sample No. 3) was tapped to be separated from the slag.

Table 24

| Sample No. | Composition of Molten Ferrochromium C | Cr | Fe | P | S |
|---|---|---|---|---|---|
| 1 | 4.8 | 61 | 30 | 0.038 | 0.035 |
| 2 | 5.1 | 61 | 30 | 0.012 | 0.008 |
| 3 | 5.0 | 61 | 30 | 0.014 | 0.006 |

(% by weight)

The resultant slag was well stabilized against formation of phosphine and other undesirable gases. In both Examples 21 and 22, the use of the flux applying apparatus gave the advantage that, as the inside refractory lining of the air tight shield hood was eroded by the slag resulting from the added flux composition to appreciable extent, the depth of insertion of the open end of the hood below the level of the molten metal was increased with increase in the amount of refractory erosion to assist in elongating the lifetime of the receptacle.

EXAMPLE 23

Using an induction melting furnace about 100 kg of a molten ferrochromium of 7%C-63%Cr-Fe was refined by addition of 5 kg of a flux composition (Sample No. 1) in an argon atmosphere, and then separated from the resultant slag (Sample No. 2).

Table 25

| | Composition of Ferrochromium C | Cr | P | S |
|---|---|---|---|---|
| Before refining | 6.7 | 63.0 | 0.035 | 0.031 |
| After refining | 7.2 | 63.2 | 0.015 | 0.005 |

(% by weight)

Table 26

| Sample No. | Composition of flux and slag $CaC_2$ | $CaF_2$ | CaO | Ca | P |
|---|---|---|---|---|---|
| 1 | 59.5 | 20 | 20.5 | 0 | 0.001 |

Table 26-continued

| Sample No. | Composition of flux and slag | | | | |
|---|---|---|---|---|---|
| | $CaC_2$ | $CaF_2$ | CaO | Ca | P |
| 2 | 43.2 | 21 | 25.1 | 4.0 | 0.35 |

(% by weight)

Flux Composition:

3.5 kg of granular $CaC_2$ (purity: 85%, the balance being almost CaO)

1.0 kg of powdery $CaF_2$ (purity: 99% or more)

0.5 kg of powdery CaO (purity: 98% or more)

It was found that almost all of the phosphorus in the slag was in the form of calcium phosphide, and the percentage of other phosphorus compounds as reduced to phosphorus was as low as 0.002%. Such slag was treated by oxidation using a slag melting apparatus of FIG. 19 to obtain a number of stabilized slag samples of different $Ca_3P_2$ content which were then subjected to phosphine formation test in such a manner that 10 grams of each slag sample was allowed to stand in air at 25° C. with a concentration of water vapor corresponding to 100% relative humidity at 20° C. in a space of 1000 $cm^3$ to produce phosphine. The results are shown in FIG. 20.

EXAMPLE 24

In a manner similar to that of Example 23, the metal refining was made to obtain a slag of composition: 45.1% $CaC_2$, 19% $CaF_2$, 24% CaO, 4.1% Ca and 0.37% P. It was found that almost all of the phosphorus in the slag was in the form of calcium phosphide, and the percentage of other phosphorus compounds as reduced to phosphorus was as low as 0.002%. Such slag was melted by using a slag melting apparatus of FIG. 19 under an argon atmosphere, and, as it was melted, oxidized by oxygen added air. The results are shown in FIG. 21. It is evident from FIG. 21 that the melting treatment of the slag under the pure argon atmosphere leads to unchange of calcium phosphide, but the melting and oxidizing treatment under an air atmosphere leads to stabilization of the slag by converting calcium phosphide to phosphorus oxide compounds.

EXAMPLE 25

Figure 22:
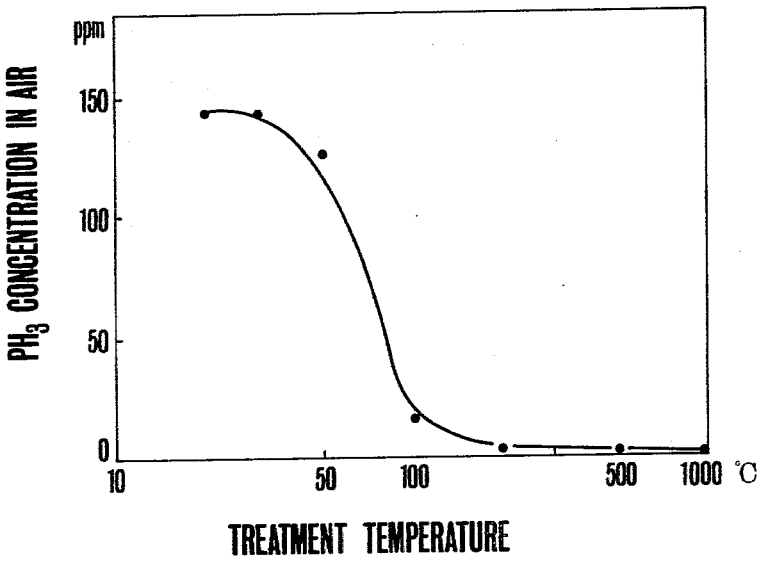
FIG. 22 is a graph showing the dependence of the amount of phosphine produced from the waste slag on the treatment temperature.

In a manner similar to that of Example 23, the metal refining was made to obtain a slag of composition: 46.0% $CaC_2$, 20% $CaF_2$, 24% caO, 0.38% P and 3.5% Ca. The slag as solidified was divided into a great number of parts having diameters in a range of 5 to 10 millimeters. These slag particles were subjected to $PH_3$ formation test at various temperatures in air with a concentration of water vapor corresponding to 100% relative humidity at 20° C. The results are shown in FIG. 22.

EXAMPLE 26

Figure 23:
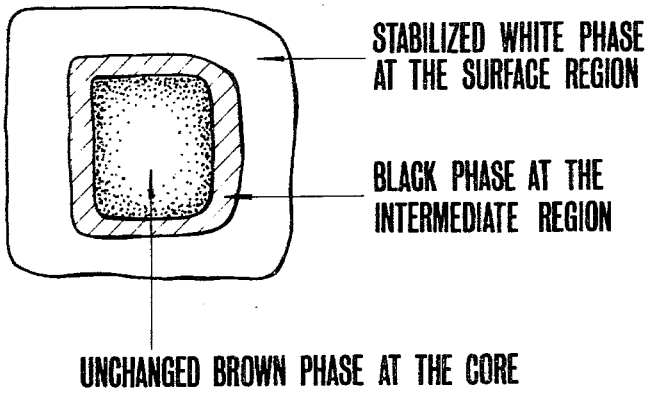
FIG. 23 is a schematic cross-sectional view of a block of waste slag during the oxidization.
Figure 24:
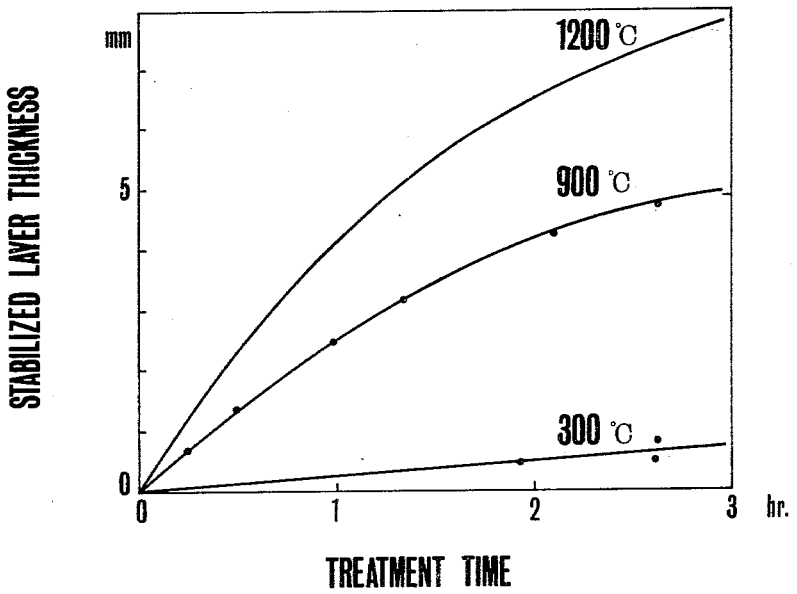
FIG. 24 is a graph showing the dependence of the speed of formation of the stabilized layer of the slag block of FIG. 23 on the treatment temperature.
Figure 25:
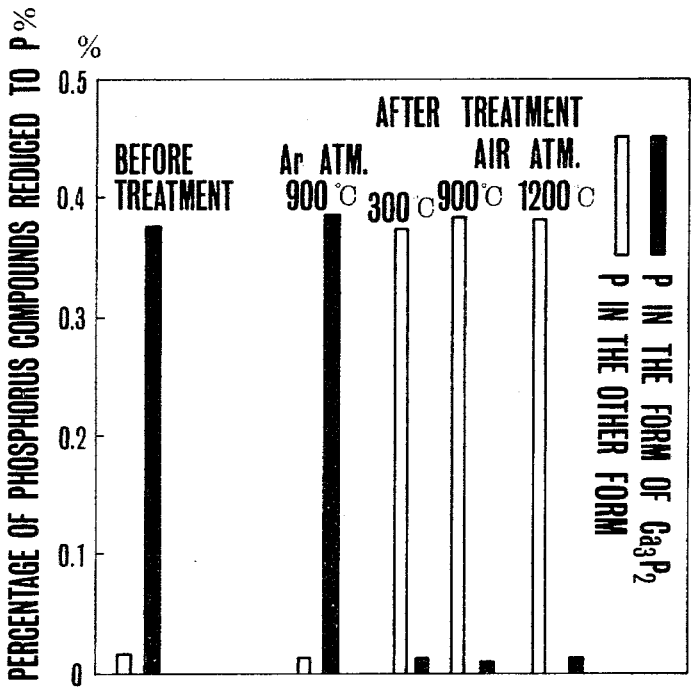
FIG. 25 is a graph showing variation of the proportion of $Ca_3P_2$ and other phosphorus compounds in the waste slag surface layer as it is treated either in an argon atmosphere at 900° C., or in an oxidizing atmosphere at a temperature of 300° C., 900° C. or 1200° C.

In a manner similar to that of Example 23, a slag of the fouthing composition was formed: 45.3% $CaC_2$, 19% $CaF_2$, 22.3% CaO, 3.6% Ca and 0.38% P. The slag was divided to parts each having a diameter of about 5 cm which were then oxidized in air by varying the temperature from 300° C. to 1200° C. The cross-sectional view of the oxidized slag part is shown in FIG. 23. Variation with time of the thickness of the whitened portion of the slag part is shown in FIG. 24. Further, the concentrations of calcium phosphide and other phosphorus compounds in the surface portion of the slag are shown in FIG. 25.

EXAMPLE 27

A molten crude stainless steel of composition: 0.61% C, 18.0% Cr, 7.9% Ni, 0.028% P and 0.019% S in an electric furnace was transferred through a pony ladle of FIG. 17 to a receptacle, and then dephosphorized by addition of 5 kg/t of a flux composition shown in Table 28 below to produce a molten steel of composition: 0.69% C, 18.0% Cr, 8.0% Ni, 0.013% P and 0.007% S. Then the molten steel was tapped from the receptacle to leave the slag behind. Thereafter, the receptacle was assembled with a burner by means of which the slag was oxidized in either of two different ways A and B shown in Table 27 below. The results are shown in Table 28 below.

Table 27

| | A | B |
|---|---|---|
| Combustion gas | Coke furnace gas | LD-converter gas |
| Oxygen gas source for combustion | Air | Oxygen added air ($O_2$ : 70%) |
| Excess ratio of oxygen gas | 1.3 | 1.3 |
| Additive | None | Iron powder (0.05 kg/t flux) $SiO_2$ (0.12 kg/t flux) |
| Average temperature at Refractory surface | 1250° C. | 1180° C. |
| Heating time | 3.5 hours | 4.2 hours |

Table 28

| | Composition of flux and slag | | | |
|---|---|---|---|---|
| | | Slag | | |
| | | | After Oxidation | |
| | Flux | Before Oxidation | A | B |
| $CaC_2$ | 45 | 21 | 0.1 | 0.1 |
| $CaF_2$ | 40 | 38 | 32 | 30 |
| CaO | 12 | 32 | 51 | 45 |
| $SiO_2$ | — | 1.2 | 1.5 | 12.5 |
| FeO | — | 0.1 | 1.4 | 5.6 |
| Total P | — | 2.2 | 2.1 | 1.9 |
| P as $Ca_3P_2$ | — | 2.1 | 0.1 | 0.1 |

(% by weight)

EXAMPLE 28

In a manner similar to that of Example 27, a slag obtained after the dephosphorizing operation was exposed to the air and cooled down to about 800° C. in 30 minutes. Next the slag holding receptacle was covered, into which carbon dioxide gas was supplied as to assure 10% or more $CO_2$ in the atmosphere, then allowed to stand therein until the temperature of the slag became 200° C. By this treatment, a $CaCO_3$ coat of a thickness of about 20 microns was formed on the surface of the oxidized slag with the oxidized portion having a thickness of about 1 millimeter.

EXAMPLE 29

In a manner similar to that of Example 27, a slag was obtained after the dephosphorizing operation, and then oxidized by the oxidizing flame of a burner supplied with a converter exhaust gas and an oxygen added air for combustion. Thereafter, the slag was exposed to the $CO_2$ atmosphere in a manner similar to that shown in Example 28, and was cooled down to 300° C. in 6 hours. In this case, the thickness of the $CaCO_3$ coat was about 4.5 millimeters, and the thickness of the oxidized portion was about 10 millimeters. Thus treated slag was allowed to stand outdoor without causing collapse by aeration and formation of phosphine.

EXAMPLE 30

In a manner similar to that of Example 27, a slag obtained after the dephosphorizing operation was retained in the slag holding receptacle, and another molten steel (Sample No. 1) together with 5 kg/t of iron oxide and 3 kg/t of silica was charged onto the slag in the receptacle. The metal and slag compositions are shown by Sample No. 2 in Table 29.

Table 29

| Sample | Composition of Added Molten Steel and Slag | | | | | | | | | | | |
|---|---|---|---|---|---|---|---|---|---|---|---|---|
| | Added Molten Steel | | | | | Slag | | | | | | |
| No. | C | Si | P | S | Cr | $CaC_2$ | CaO | $CaF_2$ | T . Fe | $SiO_2$ | $Ca_3P_2$ | $P_2O_5$ |
| 1 | 0.10 | 0.10 | 0.020 | 0.015 | 0.01 | 21 | 32 | 38 | <0.1 | 1.2 | 2.1 | <0.1 |
| 2 | 0.09 | 0.12 | 0.018 | 0.012 | 0.3 | <0.1 | 48 | 19 | 15 | 10 | 0.02 | 3.4 |

EXAMPLE 31

In a manner similar to that of Example 27, a slag obtained after the dephosphorizing operation was retained in the slag holding receptacle and a molten pig iron (Sample No. 1) was charged onto the plag in the receptacle. The mixture was treated by the conventional oxygen blowing method to stabilize the slag (Sample No. 2). The results are shown in Table 30 below.

Table 30

| Sample | Added Molten Pig Iron | | | | | Slag | | | | | | |
|---|---|---|---|---|---|---|---|---|---|---|---|---|
| No. | C | Si | P | S | Cr | $CaC_2$ | CaO | $CaF_2$ | T . Fe | $SiO_2$ | $Ca_3P_2$ | $P_2O_5$ |
| 1 | 4.1 | 0.5 | 0.10 | 0.03 | 0.1 | 21 | 32 | 38 | <0.1 | 1.2 | 2.1 | <0.1 |
| 2 | 0.05 | 0.01 | 0.01 | 0.01 | 0.1 | <0.1 | 48 | 5 | 18 | 25 | 0.03 | 2.8 |

(% by weight)

What is claimed is:

1. A method of dephosphorizing a molten alloy containing at least about 4% in total of elements more oxidizable than iron and having a carbon content lower than the solubility of carbon in the molten alloy comprising adding a flux composition comprising 3 to 90% by weight of calcium carbide and not less than 10% in total of at least one alkali earth metal halide under a non-oxidizing atmosphere satisfying the condition:

$$P_{O_2}+P_{CO_2}+P_{H_2O}+P_{SO_2}<60 \text{ mmHg.}$$

2. A process for producing a low phosphorous stainless steel comprising a first step of smelting a high chrome ferrous metal containing at least about 4% in total of elements more oxidizable than iron and having a carbon content of 0.2 to 2.0%, a second step of refining the molten metal by addition of a flux composition comprising calcium carbide and at least one alkali earth metal fluoride in a non-oxidizing atmosphere, and a third step of performing finishing decarburization until the concentration of carbon in the resulting molten alloy reaches a predetermined level.

3. A method according to claim 1, wherein said flux composition further comprises one selected from the group consisting of metallic calcium and calcium alloys including Ca-Si, Ca-Si-Mn and Ca-Si-Fe in an amount of about 3 to 50% as calcium by weight based on the total weight of said flux composition.

4. A method according to claim 1, wherein said atmosphere contains nitrogen gas in a partial pressure of not more than about 400 mmHg.

5. A method according to claim 1, wherein after the oxygen content of said molten metal or alloy is adjusted to about 180 p.p.m. or less, said flux composition is added thereto.

6. A method according to claim 1, wherein the percentage of calcium carbide in said flux composition is determined by the following formula $$A \geqq \sqrt{\frac{\alpha\eta}{1.5(100-\eta)}}\ (4z^2+x)$$

7. A process according to claim 2, wherein the first step includes reduction of oxides of iron and chromium by a carbonaceous reducing agent to make a molten metal in which Cr/Fe < 1.0, and subsequently removes silicon from the molten metal.

8. A process according to claim 2, wherein in the third step the flux composition is added when the molten metal is transferred from the melting furnace to a molten metal receptacle of which the interior space is maintained in a non-oxidizing atmosphere, and only the dephosphorized molten metal is tapped out from the receptacle to effect the separation between the slag and the molten metal.

9. A process according to claim 2, wherein in the second step a tiltable reactor having a gas injection plug is used and is charged with the molten metal from the first step and then with the flux composition while stirring the molten metal charge by the bubbling with non-oxidizing gas blown through the gas injection plug to perform dephosphorization, and thereafter the layer of slag is oxidized by the blowing of an oxidizing gas as directed to the above of, or into the slag layer.

10. A process according to claim 2, wherein the second and third steps are performed in such a manner that, after the slag covering the molten metal charge from the first step is pushed by a removable slag-layer breaker to expose the molten metal surface to the atmosphere, the flux composition is added to the molten metal charge through the atmosphere-exposed surface to perform dephosphorization, and thereafter the slag layer breaker is removed to permit the mixing of the slag from the first step with the slag formed in the second step.

11. A method of treating a slag separated from dephosphorized molten metal or alloy by contact with a flux comprising calcium carbide and a halide of an alkali earth metal, which comprises making the slag react with another molten metal under an oxidizing atmosphere.

12. A method of treating a slag separated from dephosphorized molten metal or alloy by contact with a flux comprising calcium carbide and a halide of an alkali earth metal, which comprises oxidizing the slag under an oxidizing atmosphere.

13. A method of treating a slag separated from dephosphorized molten metal or alloy by contact with a flux comprising calcium carbide and a halide of an alkali earth metal, which comprises oxidizing the slag by an oxidizing frame of a burner.

14. A method of treating a slag separated from dephosphorized molten metal or alloy by contact with a flux comprising calcium carbide and a halide of an alkali earth metal, which comprises exposing the slag to an oxidizing atmosphere and then to an atmosphere containing 10% or more of $CO_2$ at a temperature ranging from about 800° to 300° C.

15. The method according to claim 1 wherein said flux composition is to form a slag containing 5 to 50% of $CaC_2$ with a CaC/alkali earth metal halide ratio of 0.05 to 1.0 in case of electro-slag refining.

16. The method according to claim 1 wherein said flux comprises 20 to 80 percent of $CaC_2$ with a CaC/alkali earth metal halide ratio of 5 to 0.25 in case of refining in an oxide type refractory lining receptacle.

* * * * *